US006761426B2

(12) United States Patent
Tsuchiya et al.

(10) Patent No.: US 6,761,426 B2
(45) Date of Patent: Jul. 13, 2004

(54) CALIBRATION METHOD IN INK JET PRINTING APPARATUS

(75) Inventors: Okinori Tsuchiya, Kanagawa (JP); Shigeyasu Nagoshi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,600

(22) Filed: Jun. 19, 2002

(65) Prior Publication Data

US 2003/0001918 A1 Jan. 2, 2003

(30) Foreign Application Priority Data

Jun. 20, 2001 (JP) ..... 2001-187109

(51) Int. Cl.[7] ..... B41J 29/393
(52) U.S. Cl. ..... 347/19
(58) Field of Search ..... 347/19, 14, 23, 347/10, 12, 11, 40, 2, 5, 8, 22, 105, 104, 101, 74, 76, 35, 37, 9, 17, 68, 16; 358/406, 504

(56) References Cited

U.S. PATENT DOCUMENTS 5,416,613 A 5/1995 Rolleston et al. ..... 358/518
6,412,902 B2 * 7/2002 Matsumoto et al. ..... 347/19

FOREIGN PATENT DOCUMENTS

JP 7-209946 8/1995

* cited by examiner

*Primary Examiner*—Raquel Yvette Gordon
*Assistant Examiner*—Charles Stewart, Jr.
(74) *Attorney, Agent, or Firm*—Fitzpatrick, Cella, Harper & Scinto

(57) ABSTRACT

For calibration, a patch pattern is printed which enables patches to be measured while precisely reducing the adverse effects of a variation in patch pattern density resulting from a variation in movement speed or temperature of a printing head. Specifically, dummy patches that are not measured are printed on the periphery of measured patches. The dummy patches are printed by ejecting ink through all ejection openings in the printing head. Then, an increased dye concentration of ink is discharged from the printing head. Further, at the ends of a scanning range, at which the dummy patches are printed, the movement speed of the printing head varies significantly. Accordingly, the measured patches can be printed while the speed remains stable.

30 Claims, 24 Drawing Sheets

CALIBRATION METHOD IN INK JET PRINTING APPARATUS

This application is based on Patent Application No. 2001-187109 filed Jun. 20, 2001 in Japan, the content of which is incorporated hereinto by reference.

BACKGROUND OF THE INVENTION

1. Field of the Invention

The present invention relates to a calibration apparatus, an ink jet printing apparatus, a calibration method, and a medium on which a test image for calibration is printed, which all serve for a calibration which makes printing characteristics of a printing apparatus, such as a printer, to be constant, and in particular, to a test image used for the calibration that makes it possible to reduce an effect of variation in printing characteristics on calibration when printing a test pattern.

2. Description of the Related Art

Color input or output devices including input devices such as scanners and digital cameras and output devices such as monitors and printers have expressible specific color spaces, respectively. Thus, essentially, colors displayed on the monitor appear different when output from a printer. To eliminate this difference, in a system or environment using the above input and output devices, color matching between these devices is carried out by using profiles, i.e., data representative of color transformation characteristics for the respective devices.

For example, an output profile for a printer is generated as follows during a printer calibration process. First, on the basis of predetermined patch data consisting of signal values for R (red), G (green) and B (blue), or C (cyan), M (magenta), Y (yellow) and K (black), i.e., color signals for a color space dependent on the printer, the printer, for which the profile is to be generated, outputs a patch pattern. Next, the patch pattern is subjected to colorimetry using a densitometer or the like, to determine values such as XYZ or Lab, i.e., a color signal for a color space not dependent on the printer. Then, the relationship between the signal values for, for example, R, G, and B for the color space dependent on the printer, and the signal values for, for example, X, Y, and Z for the color space not dependent on the printer, is found. The thus found relationship between the RGB values and the XYZ values is used to determine a masking coefficient on the basis of an interaction method or a mapping from the RGB values to the XYZ values. Then the transformation relationship from the XYZ values to the RGB values, i.e., the reverse of the above transformation relationship, is determined as color modification data.

The profile thus obtained is used, for example, for an image processing executed when image data on the monitor is output by the printer. Then, the colors displayed on the monitor appear substantially the same as what is output by the printer.

In the above-described profile generating process, in which the transformation relationship from the RGB or CMYK signal values to the XYZ or Lab values is determined, as described above, generally, color patches are output and their density measured using a colorimeter or a densitometer so as to generate a correspondence table for the RGB or CMYK values and the XYZ or Lab values on the basis of the results of the measurements.

A printing apparatus such as a printer for which the above-described profile is generated may print an image with a different density depending on a printing position on a sheet even when the image is printed on the same sheet. For example, in a case of an ink jet printer, as a printing head that ejects ink to perform an ejection operation, generally, the temperature of the head increases. As a result, even if signals with the same value are input, the resulting amount of ink ejected may increase consistently with temperature. Consequently, as printing operations are sequentially performed on the sheet, the temperature of the printing head may vary, thereby varying the density depending on the printing position on the sheet. This also applies to the printing of the above-described patch pattern.

To verify such a variation in density, FIG. 1 schematically shows the distribution of the measured optical densities of a plurality of patches printed on the same sheet, which are gray patches of the same value for the R, G, and B signals, for example, R=G=B=192 as shown in FIG. 3, and are arranged in length and breadth directions to form a matrix pattern. In FIG. 1, for simplification of description and illustration, the measured densities of these patches are continuously expressed in the sheet though the patches are separated from one another. Further, the density of the patch is expressed on the basis of the density of lines in such a manner that the density of the patch increases in proportion to the density of the lines. Furthermore, FIG. 3, referenced above for the signal values, shows the contents of a distribution table (color separation table) that allows the R, G, and B signal values to be transformed into signals corresponding to the respective color inks actually used by the printer. The example shown in FIG. 3 relates to a printer using cyan (C), magenta (M), yellow (Y), and black (K) inks, as well as light cyan (lc) and light magenta (lm) inks, which have lower dye concentration than the above group of inks. Further, FIG. 3 shows a part of the table, which allows the R, G, and B signal values to be transformed into signal values for the corresponding inks, i.e., the figure shows the case in which R=G=B=192. Besides, according to this table, when R, G, B signals have values R=G=B=192 as referenced above, the yellow Y, light cyan lc, and light magenta lm inks are used for printing.

As shown in FIG. 1, the printing head performs a scanning operation in a main-scanning direction as shown by the arrow in the figure. During the scanning operation, ink is ejected through ink ejection openings of the printing head to carry out printing. Then, while the printing head is moving in the direction opposite to the main-scanning direction, shown by the arrow, the sheet is fed in a sub-scanning direction. Printing for the entire page of the sheet is performed by repeating the scanning operation of the printing head and the sheet feeding operation.

As is apparent from this figure, during the scanning operation of the printing head, the density increases along the main-scanning direction from a printing start position and along the sub-scanning direction.

FIG. 2 shows a distribution of densities similar to that of FIG. 1, wherein signal values for the patch pattern are used to eject inks so that the amount of ink or the number of ink types landing per unit area is increased compared to the patch pattern shown in FIG. 1; for example, R=G=B=96 is used in FIG. 2. This figure indicates that the tendency described in FIG. 1 becomes more significant as the total amount of ink landing per unit area increases. Further, when the number of ink types used for printing increases, this increasing easily causes the number of times of driving to be different between respective nozzles of ink types, which communicate with respective ejection openings, and thereby an ejection amount of respective nozzles of ink types individually vary so that difference in color tones between the printing positions becomes greater. That is, a rate of variation in density on the sheet becomes greater, and therefore a difference in density between the printing positions on the sheet becomes greater.

Further, a temperature variation associated with an ejecting operation of the printing head, which may cause the density to be varied as shown in FIGS. 1 and 2, generally behaves in such a manner as to gradually approach a certain relatively high temperature. This behavior basically depends on the heat accumulation and radiation characteristics of the printing head. More specifically, as the printing position in the sheet in FIG. 1 or 2 moves rightward and downward, the temperature increases as well as a difference in temperature between printing positions becomes small.

Furthermore, of course, a variation in temperature of the printing head or the variation in density resulting therefrom occurs not only during one directional scanning shown in the above-described example but also during scanning in bi-directional printing in which printing is executed both in one direction and an opposite direction. The behavior of variations in this case is such that as the printing position on the sheet in FIG. 1 or 2 moves downward, the temperature or density increases.

The patch pattern mentioned in FIGS. 1 and 2 is of the same signal values for printing the patches. However, this pattern is used to explain the variation in density or temperature for the same signal values. Of course, for a patch pattern typically used for a calibration, a plurality of patches with different signal values are printed.

Furthermore, another factor in the density variation associated with the variation in temperature is increasing in dye concentration of ink in the nozzle in the printing head, as shown in FIG. 23.

As shown in FIG. 23, dye concentration of ink in a nozzle increases during a relatively long interval of non-printing at an ambient temperature or during an interval of non-ejection state of the printing head in a state that the temperature of the printing head becomes high after continuous printing operation, because a solvent for the dye evaporates while the dye does not evaporate. Therefore, at a beginning of printing after the relatively long interval of non-printing or at a beginning of printing after the interval of non-ejection state of the printing head in continuous printing operation, the dye concentration of ejected ink becomes high and then the printed density increases.

It is also known that another factor in the variation in printing density on the same sheet is that associated with driving of the printing head for scanning. For example, the printing head is driven as shown in FIG. 4 on a movement for scanning in the mainscanning direction.

If it is assumed that the ink is ejected at equal time intervals while the printing head is being moved, dots are densely formed in areas where the printing head is moved at lower speed for scanning, while dots are sparsely formed in areas where the printing head scans at higher speed. On the other hand, in the example of driving shown in FIG. 4, in the areas other than those in which the printing head is moved at a constant speed, i.e., in acceleration and deceleration areas, the speed itself varies. In spite of this, typically, printing is also carried out in these areas (those areas in FIG. 4 which are designated "areas of density fluctuation caused by fluctuated movement speed of the printing head") in order to reduce the dimension of an apparatus in the width direction of the sheet used. However, in these areas, the speed is lower than in those areas in which the speed is constant and highest. Further, in these areas, the speed varies relatively significantly. Thus, at the side ends of the sheet, corresponding to "area of density fluctuation caused by fluctuated movement speed of the printing head", even if the same head driving signal is used for printing, dense dots tend to be formed to provide high density printing compared to the center of the sheet.

As described above, even with the same signal values, the printing density may vary depending on the print position on the sheet. In such a case, the measured density of a patch pattern printed for calibration does not precisely reflect the normal printing characteristics of the printer. As a result, calibration data such as the above-described RGB values (or CMYK values, or CMYK values and lclm values associated with light color inks)—XYZ values (or Lab values) correspondence table which is generated based on the measured density may be imprecise. Correspondingly, a printer output profile obtained on the basis of the calibration data may also be imprecise.

For example, Japanese Patent Application Laid-open No. 7-209946 (1995) discloses a known configuration that reduces a variation in measured data dependent on the print position in the sheet when a patch pattern such as the one described above is printed. That is, as shown in FIG. 5, patches are printed so as to be randomly arranged in the sheet, so that the patches present within one area of the color space (the patches of the R, G, and B values being close to each other) are positionally distributed. Accordingly, all patches of the above one area of color space are prevented from being affected by the nonuniformity of printing within the same sheet as described above. Furthermore, for a certain particular patch, a plurality of patches, which have the same color (density), are repeatedly printed, and the average of the measurements of the patches of the same color is taken as measured data for this color, thereby improving printing-measurement precision for some colors. Thus, data, on the measured density for each print position in the sheet, is obtained as one having less bias. Further, in the above publication, as shown in FIG. 5, the ends (the periphery) of the sheet are made non-printing areas, so that the area for printing the patch pattern is more toward the interior of the print sheet, thereby preventing a variation in density resulting from a variation in movement speed of the head at the ends of the sheet.

However, even though measured data obtained by randomly arranging the patches is such that all patches of colors within one area of the color space (the R, G, and B values are close to each other) are prevented from varying depending on the print position in the sheet, as described in the above publication, the measured data is likely to be data having bias about the variation in printing density caused by an increase in head temperature associated with a scanning operation of the printing head. More specifically, in the case of one-directional printing, the variation in density caused by the increase in head temperature associated with a scanning operation of the printing head generally gradually increases from a corner of the sheet (printing start position A) toward such a corner thereof (printing end position B) that these two corners are point-symmetric with respect to the center of the sheet, as shown in FIGS. 1 and 2. That is, this variation has a certain tendency. Thus, in measured data obtained from randomly arranged patches or in the mean value of measured data obtained by spatially randomly arranging some patches, this certain tendency may appear relatively markedly. That is, the randomly arranged patches are affected by the tendency of the variation in density correspondingly to the positions thereof.

Further, even if the area of non-printing is simply provided in the sheet as in the above publication, it is apparent that, though the variation in density resulting from a variation in movement speed of the printing head may be prevented at a home position side of the printing head because a serial printer has, for example, control of the movement of the printing head such that after scanning for printing in one direction a speed of the printing head is reduced at a short distance and the printing head is made to return to the home position, the above-described variation in colorimetric data attributed to the variation in the head temperature cannot be reduced.

Further, a method disclosed in the publication cannot reduce a variation in colorimetric data attributed to increasing of dye concentration in the nozzle, which occurs after an interval between continuous printing operations.

SUMMARY OF THE INVENTION

An object of the present invention is to provide a calibration apparatus, an ink jet printing apparatus, a calibration method, and a print medium having a calibration test image printed thereon, which all serve to print a patch pattern that enables measurements of patches that precisely reduce an effect of a variation in density in the patch pattern on the measurement, the variation resulting from a variation in head temperature, a variation in movement speed and a variation in dye concentration of ink in a nozzle of a printing head.

In the first aspect of the present invention, there is provided a calibration apparatus for outputting test image data to cause a printing apparatus to print a test image used for a calibration for the printing apparatus, wherein the test image includes a measure image which is a subject of a measurement and a dummy image which is not a subject of the measurement, and the dummy image is printed at least at a part of a periphery of an area on which the measure image is printed, on a printing medium.

Here, the printing apparatus may be one that repeats scanning of a printing head across the printing medium and transporting of the printing medium at a predetermined amount in a direction different from a direction of the scanning of the printing head so as to print the test image, and the test image may include dummy images printed at both ends of a scanning range of one scanning of the printing head and the measure image printed so that the measure image is positioned between the dummy images of the respective ends.

The printing apparatus, based on the test image data, may print a pair of the test images which include the respective measure images whose print positions in the printing medium are symmetrical to each other with respect to a center of an arrangement of the measure images.

In the second aspect of the present invention, there is provided an ink jet printing apparatus which uses a printing head ejecting ink to print a test image used for a calibration, wherein when printing the test image ink ejection is executed from the printing head on an area other than an area on which the test image is printed.

In the third aspect of the present invention, there is provided a calibration method including a process for outputting test image data to cause a printing apparatus to print a test image used for a calibration of the printing apparatus, wherein the test image includes a measure image which is a subject of a measurement and a dummy image which is not a subject of the measurement, and the dummy image is printed at least at a part of a periphery of an area on which the measure image is printed, on a printing medium.

Here, the printing apparatus may be one that repeats scanning of a printing head across the printing medium and transporting of the printing medium at a predetermined amount in a direction different from a direction of the scanning of the printing head so as to print the test image, and the test image may include dummy images printed at both ends of a scanning range of one scanning of the printing head and the measure image printed so that the measure image is positioned between the dummy images of the respective ends.

The printing apparatus, based on the test image data, may print a pair of the test images which include the respective measure images whose print positions on the printing medium are symmetrical to each other with respect to a center of an arrangement of the measure image.

A pair of the test images may be printed which include the respective measure images whose print positions on the printing medium are symmetrical to each other with respect to a center of an arrangement of the measure image.

According to the above structure, a test image used for calibration includes measure images to be measured and dummy images that are not measured. The dummy images are printed on at least a part of a periphery of a printing medium, which is located around the area on which the measure images are printed. Accordingly, before the measure images are printed, printing of the dummy images can be performed to precisely reduce and stabilize a variation in density of patches in a patch pattern caused by a variation in a moving speed of a printing head on printing operation and a variation in dye concentration of ink in a nozzle of the printing head. More specifically, in a system including also a serial printer in which the printing head moves only across a part of a scanning area for which ejection data is present when performing a scanning operation, printing of the dummy image allows the speed change of the printing head to be shifted to a constant speed area during printing the dummy image to stabilize the speed on printing the measure images. Further, as to the variation in dye concentration of ink in the nozzle of the printing head, since ink in the nozzle is removed by printing of the dummy patch before printing the measure images, the dye concentration of ink can be made constant during printing the measure images. Thereby, a variation in printing density, which results from the variations in temperature of the printing head and in dye concentration on printing the measure images, can be reduced. Furthermore, printing of the dummy image can avoid change in a mix ratio of C, M, Y, K inks for printing the measure images, which is caused by mixing of different type inks near the ejection openings of the printing head.

According to a further preferred structure, the test image is such that the dummy images are printed at the opposite ends of a single scanning range of the printing head and the measure images printed so as to be sandwiched between the dummy images printed at the opposite ends. Accordingly, when the test image is printed by scanning the printing head, the measure images can be prevented from being printed at the opposite ends of the scanning range, where the speed may vary in connection with the scanning movement. This also hinders a variation in printing density of the measure images attributed to a variation in speed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

[First Embodiment]

Figure 6:
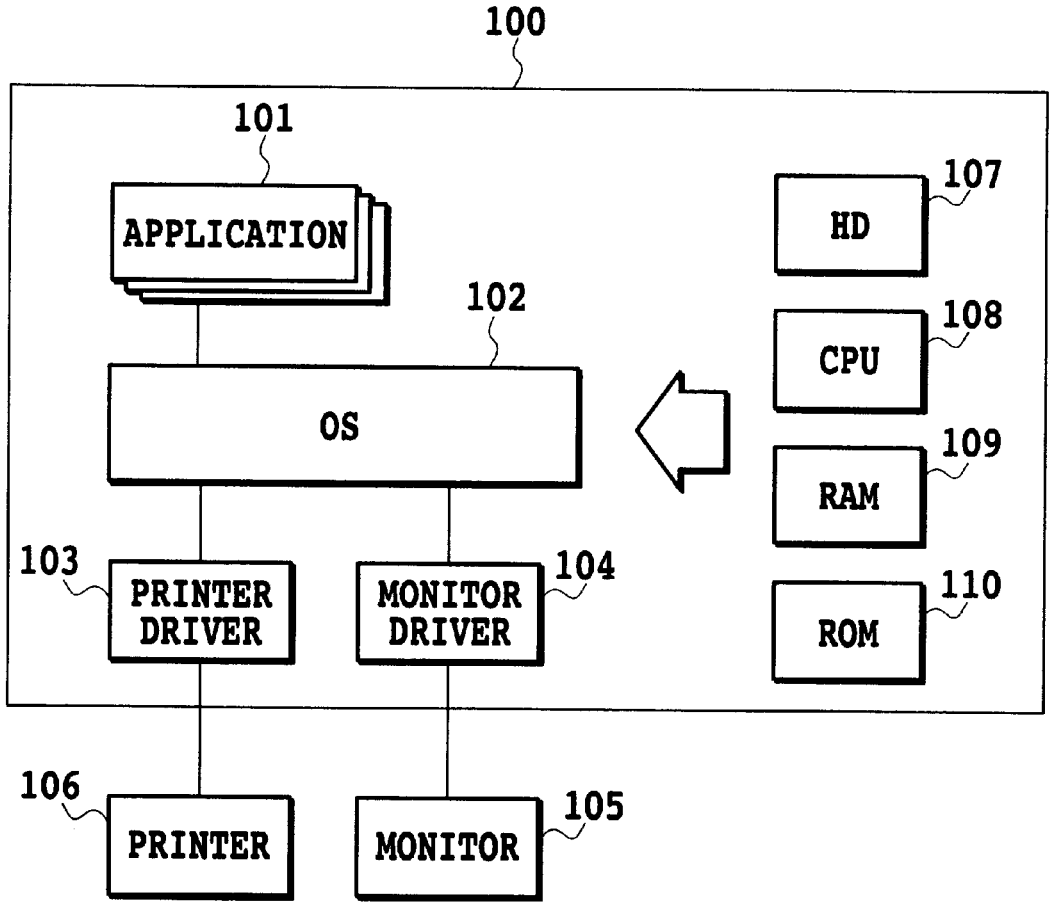
FIG. 6 is a block diagram showing the configuration of a printing system according to an embodiment of the present invention.

FIG. 6 is a block diagram showing the configuration of a printing system according to an embodiment of the present invention.

In FIG. 6, a host computer 100 has a printer 106 and a monitor 105 of, for example, an ink jet printing apparatus connected thereto. The host computer 100 has application software 101 such as a word processor, a spreadsheet and an Internet browser, an OS (Operating System) 102, a printer driver 103 that processes a group of various drawing commands (an image drawing command, a text drawing command, and a graphics drawing command) issued to the OS 102 by the applications and which are indicative of output images, and generates printing data, and a monitor driver 104 that processes the group of various drawing commands issued by the applications to perform displaying on the monitor 105.

The host computer 100 comprises a central processing unit (CPU) 108, a hard disk drive (HD) 107, a random access memory (RAM) 109, a read only memory (ROM) 110, and other components of hardware on which the software can operate.

An embodiment of the host computer shown in FIG. 6 is, for example, a common IBM AT compatible personal computer using Microsoft Windows 95 as an OS, having an arbitrary application capable of printing installed therein, and having a monitor and a printer connected thereto.

On the basis of an image displayed on the monitor, the host computer 100 uses an application 101 to generate output image data using text data classified into text such as characters, graphics data classified into graphics, and image data classified into natural images. To output and print output image data, the application 101 requests a print output from the OS 102 and issues a group of drawing commands, composed of a graphics drawing command for the graphics data portion and an image drawing command for the image data portion, to the OS 102. The Os 102 receives a request for output from the application 101 and issues the group of drawing commands to the printer driver 103 corresponding to a printer 106 used for printing output.

The printer driver 103 processes the print request and group of drawing commands input by the OS 102, to generate print data that can be printed by a printer 106, and then transfers the print data to the printer 106. More specifically, if the printer 106 is a raster printer that carries out printing by scanning the printing head, in response to the drawing commands from the OS 102, the printer driver 103 sequentially performs an image processing including a process based on a profile according to an embodiment of the present invention. Then, the data is rasterized and stored in a page memory containing 24 bits for each of the R, G, and B signals. After rasterizing all drawing commands, the printer driver 103 transforms the contents of the RGB 24-bit page memory into a data format that can be printed by the printer, for example, C, M, Y, K, lc, lm data, which is then transferred to the printer.

Figure 7:
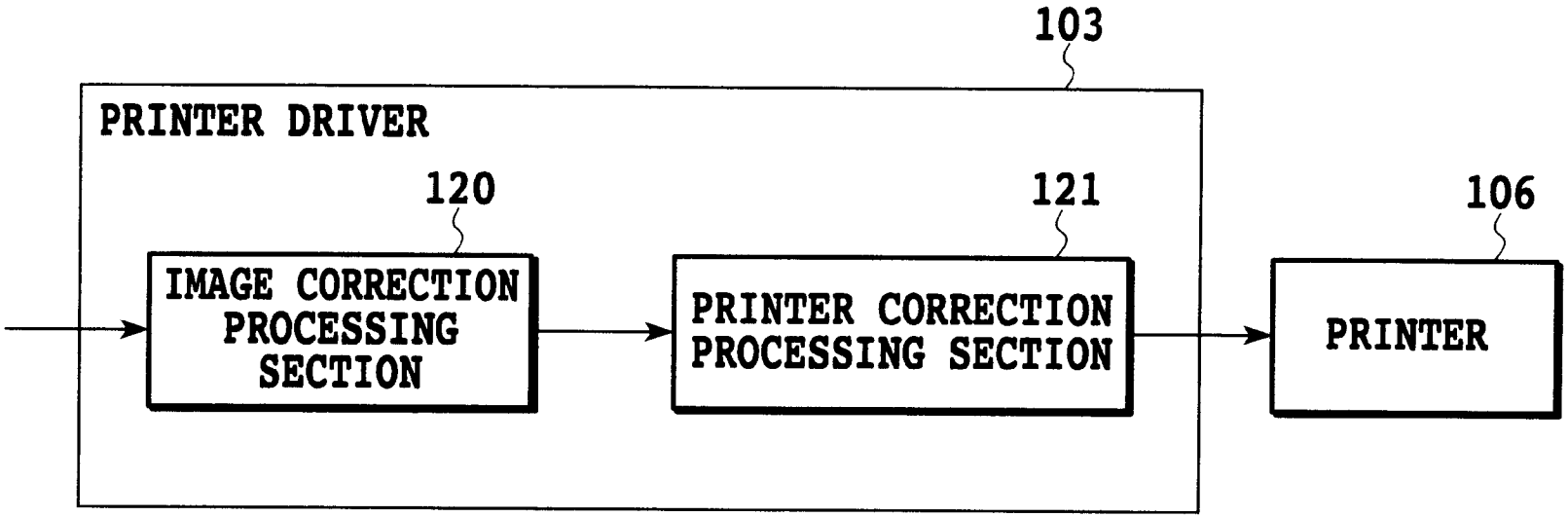
FIG. 7 is a block diagram showing the configuration of a printer driver in detail, which operates in a host computer of the above system.

FIG. 7 is a diagram showing a process executed by the printer driver 103.

An image correcting process section 120 of the printer driver 103 executes an image correcting process on color information contained in the group of drawing commands input by the OS 102. This image correcting process transforms RGB color information into luminance and color difference signals, executes an exposure correcting process on the luminance signal, and then inversely transforms the corrected luminance and color difference signals into RGB color information.

Then, the printer correcting process section 121 first rasterizes the drawing commands on the basis of the RGB color information processed as described above, to generate a raster image on the page memory containing 24 bits for each of the R, G, and B signals. The printer correcting process section 121 then executes a color reproduction space mapping process, a process of separating the image into C, M, Y, K, lc, lm colors, and a gradation correcting process. The printer correcting process section 121 finally generates C, M, Y, K, lc, lm data for each pixel depending on the color reproducibility of the printer 106. Then, this print data, which can be printed by the printer 106, is transferred to the printer 106.

Further, in calibrating the printer 106, the host computer 100 configured as described above generates a patch pattern, outputs it to the printer 106, and executes a color matching process on the basis of the results of measurements of the patch pattern as described later. In this sense, in the present specification, the host computer 100 constitutes a calibration apparatus. However, if a series of processes relating to the calibration described later or some of these processes are executed by an apparatus different from the host computer such as the printer 106, then this apparatus of course constitutes the calibration apparatus.

Figure 8:
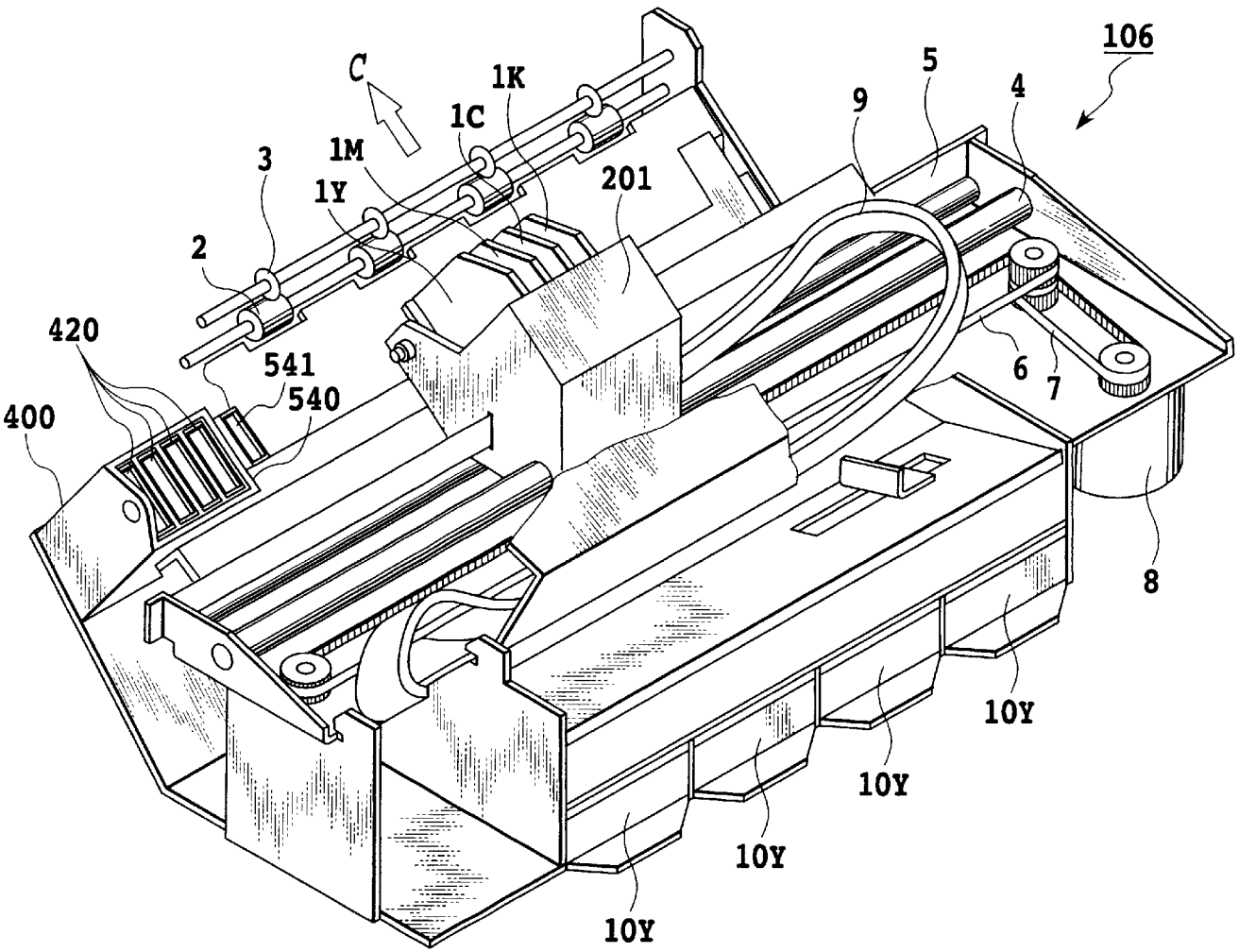
FIG. 8 is a perspective view of the external configuration of an ink jet printer constituting the printing system.

FIG. 8 is a perspective view showing the above-described printer 106. The printer according to this embodiment comprises printing heads based on the ink jet method and is a serial type printing apparatus that carries out printing by scanning the printing heads over a printing medium such as a sheet.

In this embodiment, six ink types including C, M, Y, K, lc, and lm inks are used, but for simplification of illustration in FIG. 8 and of description, four inks including C, M, Y, and K and corresponding printing heads are used in the following description. However, it should be appreciated that the basic operation of the printing apparatus is similar irrespective of the type of ink used.

In FIG. 8, printing heads 1C, 1M, 1Y, and 1K each comprise a plurality of ejection openings through which ink is ejected. Nozzles communicating with respective ejection openings are each provided with an electro-thermal conversion element such as a heater so as to use thermal energy generated by the element to produce bubbles in the ink so that the pressure of the bubbles can cause ink droplets to be ejected through the ejection openings. The different color inks are ejected from the respective printing heads, and color dots composed of these ink droplets are mixed together to print a color image or the like on the printing medium.

Figure 22:
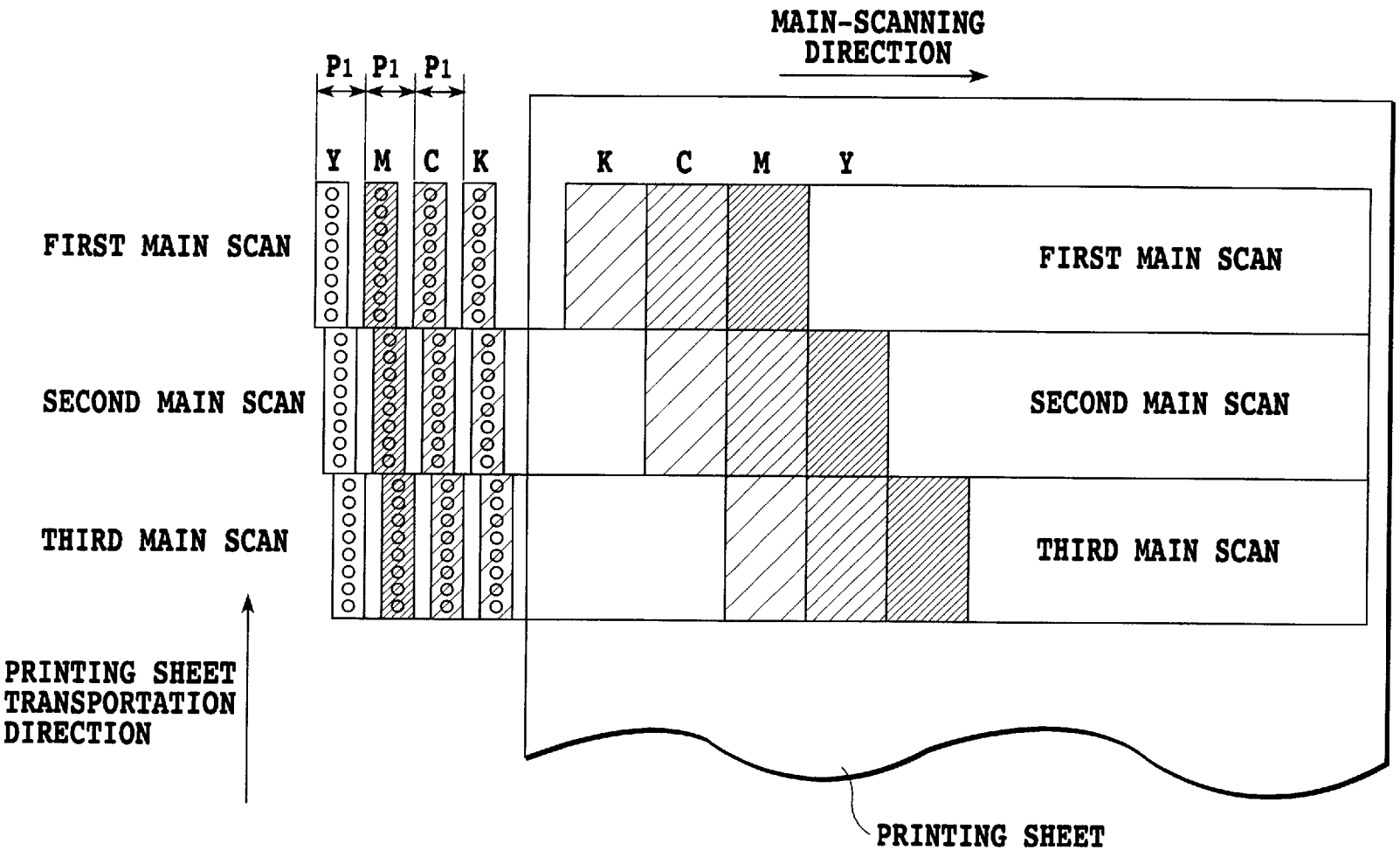
FIG. 22 is a diagram particularly showing the arrangement of the printing heads shown in FIG. 8.

The printing heads 1K, 1C, 1M, and 1Y according to this embodiment are detachably mounted on a carriage 201 at predetermined intervals in a main-scanning direction, in which the carriage is moved. Accordingly, during scanning, the inks are ejected for printing in the same order as that in which the printing heads are mounted. For example, if a red (hereinafter referred to as "R") image is to be printed, a magenta (M) ink droplet is first ejected and applied to the printing medium. Then, a yellow (Y) ink droplet lands on the M ink droplet to form a red dot. Likewise, for green (hereinafter referred to as "G"), the C and Y inks are ejected in this order, and for blue (hereinafter referred to as "B"), the C and M inks are ejected in this order, so that the corresponding droplets can land on the printing medium to form dots of the corresponding colors. It is needless to say that timings with which the inks are ejected vary depending on the intervals at which the printing heads are arranged. For example, if G dots are to be formed, as is apparent from the arrangement of the printing heads and printing method using these printing heads shown in FIG. 22, the C ink is ejected and after a time corresponding to two pitches ($2P_1$) of the printing head interval has passed, the Y ink is ejected.

The carriage 201 can be moved along a guide shaft 4 and a guide plate 5 by a driving force from a carriage driving motor 8 transmitted by transmission mechanisms such as belts 6 and 7. This movement enables a scanning operation or the like of the printing heads described above. For each scanning operation of the printing heads by the carriage 201, a transportation mechanism (not shown) carries out sheet feeding, i.e., transports a printing medium such as a printing sheet a predetermined distance in a sub-scanning direction (shown by the arrow C in the figure), thereby printing an image or the like all over the sheet.

A recovery unit 400 is provided at one end of the range in which the carriage 201 is moved. The recovery unit 400 comprises caps 420 and blades 640 corresponding to the printing heads to execute a process required to maintain the proper ejection performance of each printing head. For example, while the printer is not in operation for printing, the caps 420 cover the surfaces of the corresponding printing heads in which ejection openings are formed. This prevents the water or the like in the ink from evaporating through the ejection openings, thereby preventing the ink in the ejection openings from becoming more viscous or being dried while the printer is not in operation. Further, the recovery unit 400 uses predetermined pumps to set the interior of the caps 420 to negative pressure with the ejection opening surfaces of the printing heads covered as described above, thus suctioning and discharging the ink via the ejection openings. This enables more viscous ink or dried ink to be removed from the nozzles. Further, the blades 640 are installed so as to project into the movement range of the printing heads. Thus, as the printing heads are moved, the blades 640 clean the ejection opening surfaces thereof to remove fine ink or water droplets or dust deposited on the surfaces. The recovery unit 400, which has the above-described functions, is provided at the position at which the printing heads stand by while the apparatus is not in operation as described above. Thus, this position is referred to as a "home position (hereinafter also referred to as a HP").

The printing heads are supplied with ink from ink cassettes 10K, 10C, 10M and 10Y via a supply tube array 9.

Figure 9:
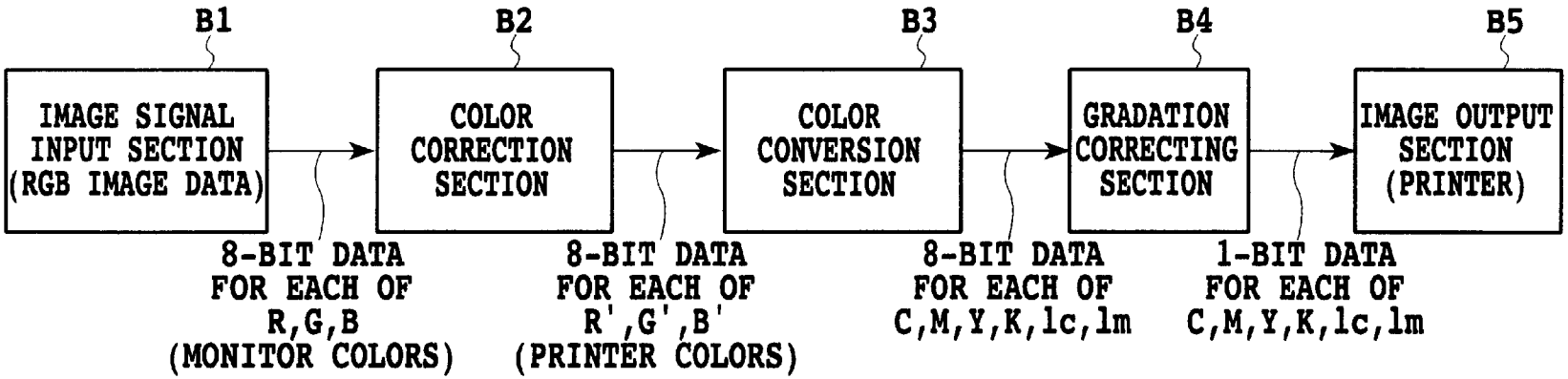
FIG. 9 is a block diagram showing in detail the configuration of a printer correcting process section of the printer driver, shown in FIG. 7, the printer correcting process section being used for an image processing for normal printing.

FIG. 9 shows in detail the printer correcting process section 121 of the printer driver, shown in FIG. 7.

As shown in FIG. 9, image signals input by the image correcting process section 120 (see FIG. 7) are first input to an image signal input section B1 as R, G, B data. An image signal source for the input section B1 is, for example, the page memory described in FIG. 7 and retains rasterized images. The image signals are input to a color correction section B2, which then executes a color matching process on the signals to transform (convert) them into R', G', B' signals depending on the printer. In this regard, generation of a ®' G' B'—L*a*b*) table used to generate a profile (pre-color-process table) for color matching which is used for the color matching process is a process involved in calibration according to this embodiment as described below in detail with reference to FIG. 10 and other figures.

Figure 3:
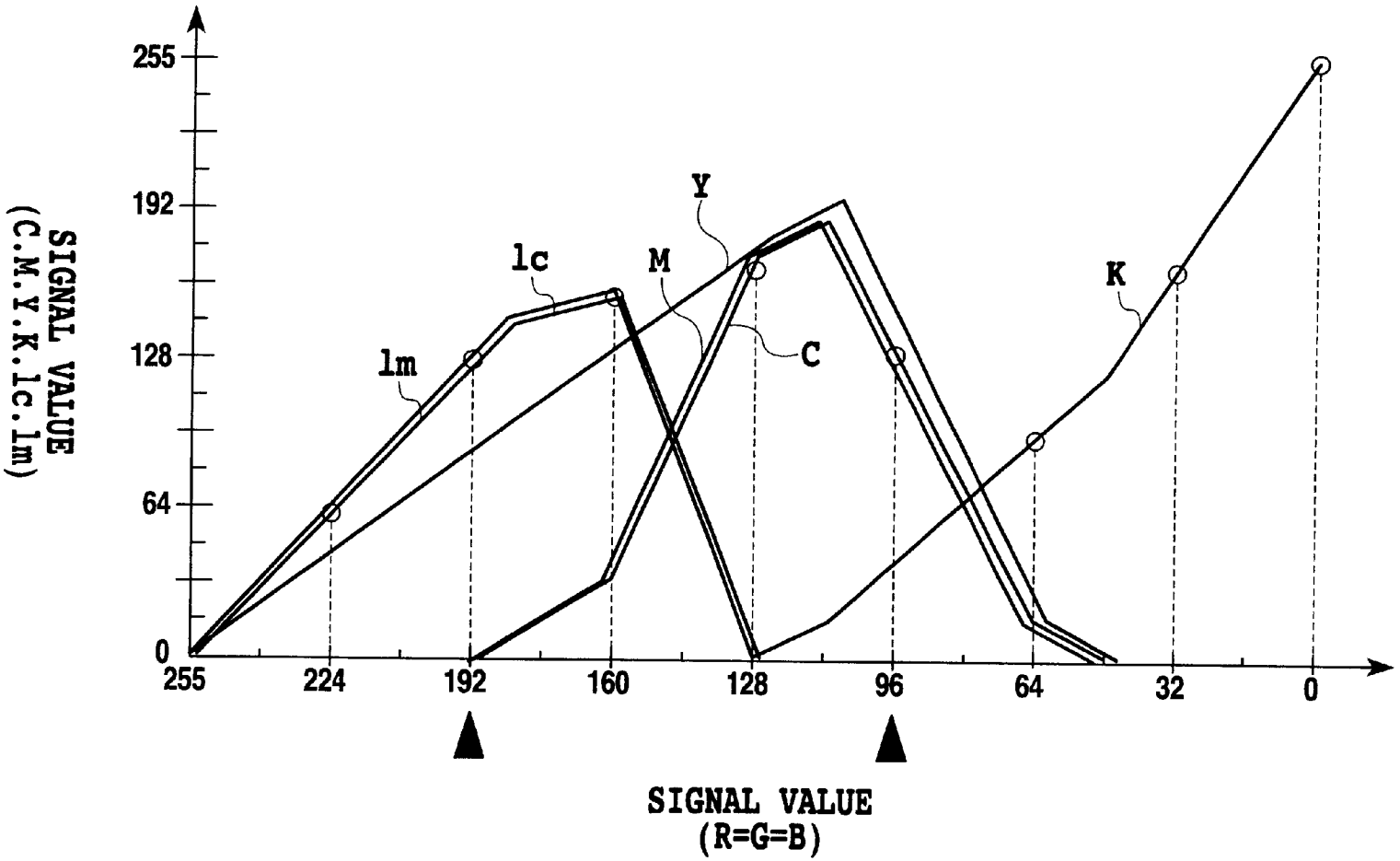
FIG. 3 is a graph schematically showing a part of a table that transforms data consisting of R, G, and B signals into signals corresponding to inks for printing heads.

The signals obtained by the color correction section B2 are input to a color conversion section B3, which then executes a color separating process (post color process) on the signals according to the printing characteristics of the printer. Thus, signals for C, M, Y. K, lc, and lm are obtained. This color process uses an allotment (color separation) table such as the one described in FIG. 3. Next, a gradation correcting section B4 executes a gradation correction process including a binarization as well as a halftone process on these signals. An image output section B5 outputs these signals to the printer 106 using predetermined timings.

The configuration of the printer correcting process section 121, shown in FIG. 9, is as used for a normal printing process. When a patch pattern is printed as a test image for calibration, different circuits are used to execute the printer correcting process or different printer correcting processes are executed so that each patch printed at the end of the sheet and each patch printed in the other areas are subjected to different processes.

The above-described color correction section B2 uses a lookup table (hereinafter referred to as a "LUT" or simply a "table") for the color process. A process of generating the lookup table, i.e., a calibration process according to this embodiment, will be described below.

Figure 10:
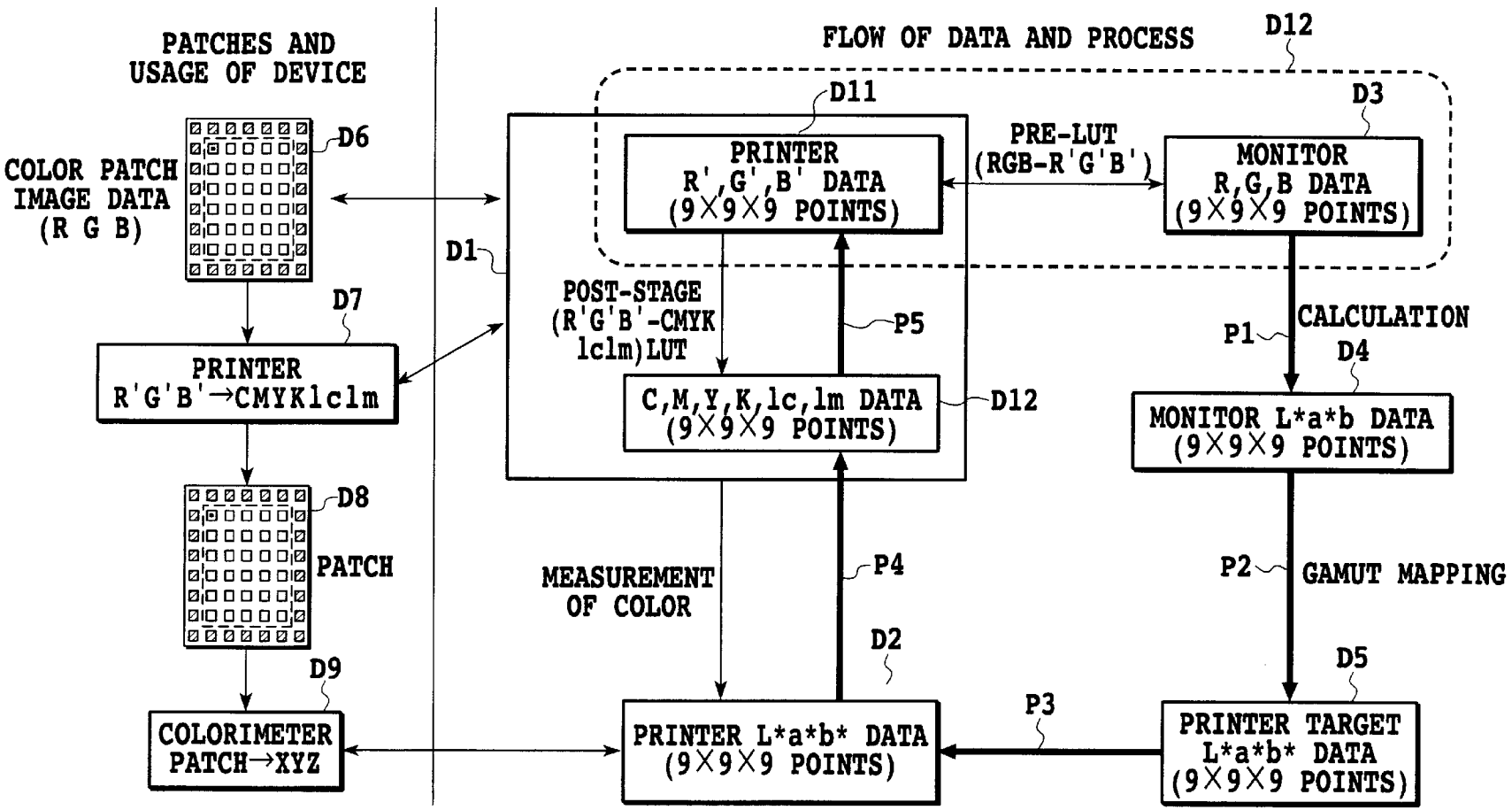
FIG. 10 is a diagram illustrating a data transformation relationship observed in a color matching process executed in the above printing system.

FIG. 10 is a block diagram illustrating a process of generating the LUT, used for the color correction section B2, by focusing on the flow of each data.

The LUT of the color correction section B2 is a three-dimensional lookup table used for color matching between the monitor 105 of signals R, G, and B, and the printer 106 of signals R', G', and B'; these output apparatuses have different color spaces. In FIG. 10, this table is shown as LUT D12.

This LUT is generally generated by transforming RGB data D3 for the monitor 105 and R'G'B' data D11 for the printer 106 into data for a color space (device non-dependent space) not dependent on these apparatuses, respectively, and by making correspondence between RGB data D3 for the monitor and the R'G'B' data D11 for the printer in this color space.

Transformation of Space Based on Monitor RGB into Device Non-dependent Space

The space based on the RGB data for the monitor can be transformed into an XYZ space, a device non-dependent space, using a transformation equation specified in, for example, the sRGB standard. In this embodiment, the XYZ space is further transformed into an L*a*b* space, specified by the CIE, taking into account human color perception.

Transformation of Space Based on Printer R'G'B' into Device Non-dependent Space

In this embodiment, printing can be carried out by ejecting six types of color ink including the inks C, M, Y, and K, which have a density typically used in the printer, and light cyan and magenta inks lc and lm, which have a lower dye density. Data for six colors used in this printer is obtained by the color conversion section B3 (see FIG. 9) on the basis of signals R', G', and B' obtained through color matching executed by the color correction section B2. On the other hand, with an ink jet printer as in this embodiment, printing grade is affected by, for example, the granular feeling of dots formed from the ink, the amount of ink received by a printing medium per unit time or unit area, or the like. Thus, in view of these conditions, the LUT D1 (FIG. 10) of the color conversion section B3 is set so that the section B3 executes a color separating process (ink distribution process) on the R'G'B' input data to output proper C, M, Y, K, lc, and lm data.

In this manner, the signals R', G', and B' obtained through color matching executed by the color correction section B2 are used to operate, via the color conversion section B3, a color process executed by the printer. Therefore, the process does not depend on the configuration of the printer, e.g., whether the printer uses the four colors, C,M,Y and K, or the six colors, C, M, Y, K, lc and lm. As a result, the printer can be handled as an RGB device that allows its color process to be operated simply on the basis of the R'G'B' data.

In determining the relationship between the R'G'B' data and the device non-dependent space into which the R'G'B' data is transformed as described above, it is difficult to predict the color development characteristics of the printer. That is, with an ink jet printer as in this embodiment, it is difficult to predict the color development characteristics of the printer because of complicated and diverse factors such as a change in color development associated with mixture of the inks or the manner in which the ink permeates through the printing medium.

Thus, in general, patches are printed at appropriate sampling intervals based on combinations of predetermined R', G', and B' data for which the printer can reproduce a color. Then, the printed patches are directly measured using a colorimetric instrument such as Spectrolio, manufactured by Gretag, to determine lattice data of the LUT corresponding to a color reproduction space based on the signals R', G', and B' for the printer, i.e. L*a*b* space data corresponding to the predetermined signals R', G', and B' for the printer.

The values for. the L*a*b* space (coordinate values in the device non-dependent space) corresponding to arbitrary signals R', G', and B' for a printer can be determined by executing a known interpolation process such as tetrahedral interpolation on the L*a*b* values for the lattice points.

In this embodiment, the intervals at which the R'G'B' signal values for the printer are sampled are each 32; these intervals are related to lattice intervals for the LUT. As a result, the value of 0 to 255 for each of the R', G', and B' signals are used in an LUT of lattice points based on the nine values of 0, 32, 64, 96, 128, 160, 192, 224, and 255 for each color, i.e., 9×9×9=729 lattice points (D11 in FIG. 10).

Obtaining Color Reproduction Characteristics of Printer in Device Non-dependent Space As described above, the R'G'B' space for the printer is transformed into the device non-dependent space by printing patches and subjecting them to colorimetry. In this case, as described previously, when patches are printed, in view of the fact that a variation in printing density may result from a variation in temperature of the printing head, a patch pattern that serves to reduce the variation in printing density is printed and processing on colorimetric data that serves to reduce the variation is executed.

(Patch Pattern)

Figure 1:
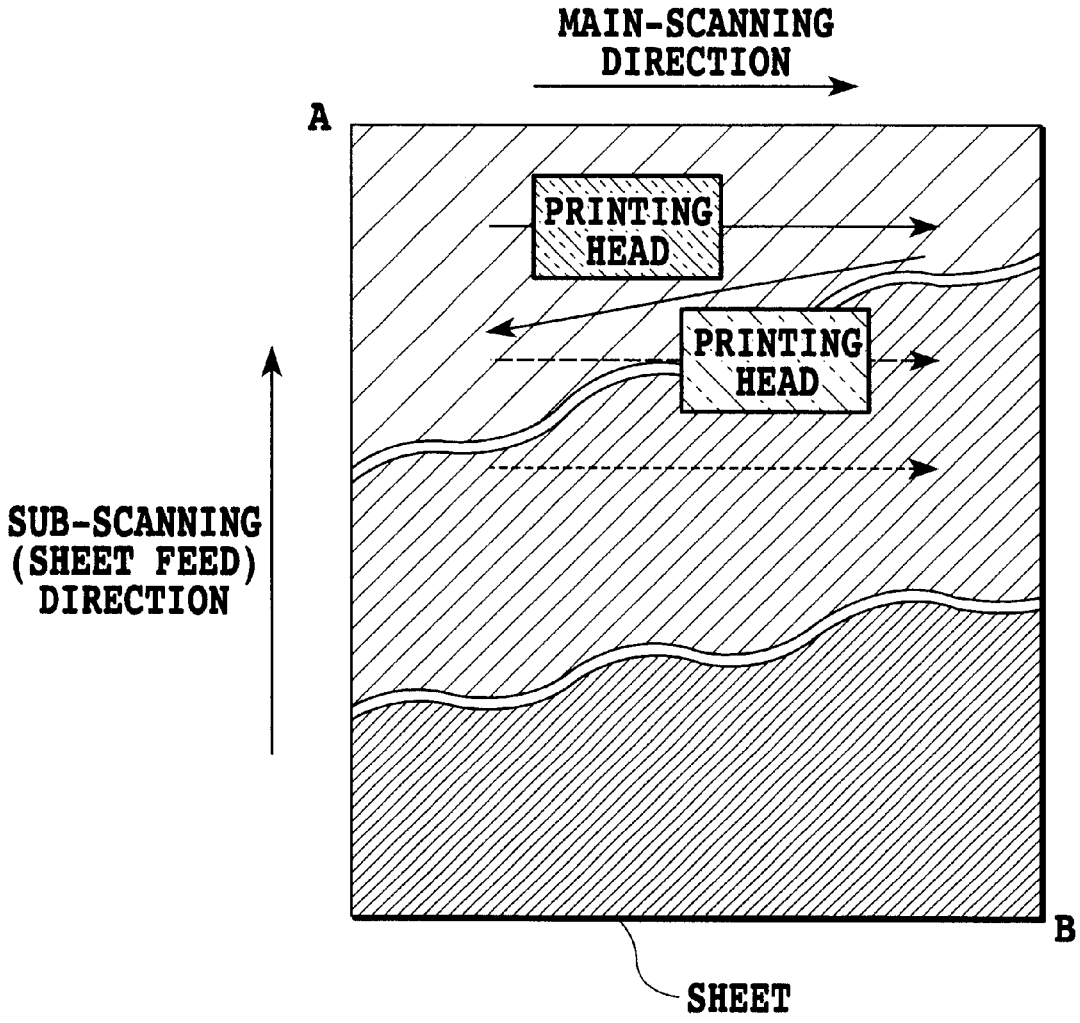
FIG. 1 is a diagram schematically showing the distribution of density observed when a plurality of gray patches for which R, G, and B data have the same value are arranged in a matrix form within the same sheet.
Figure 2:
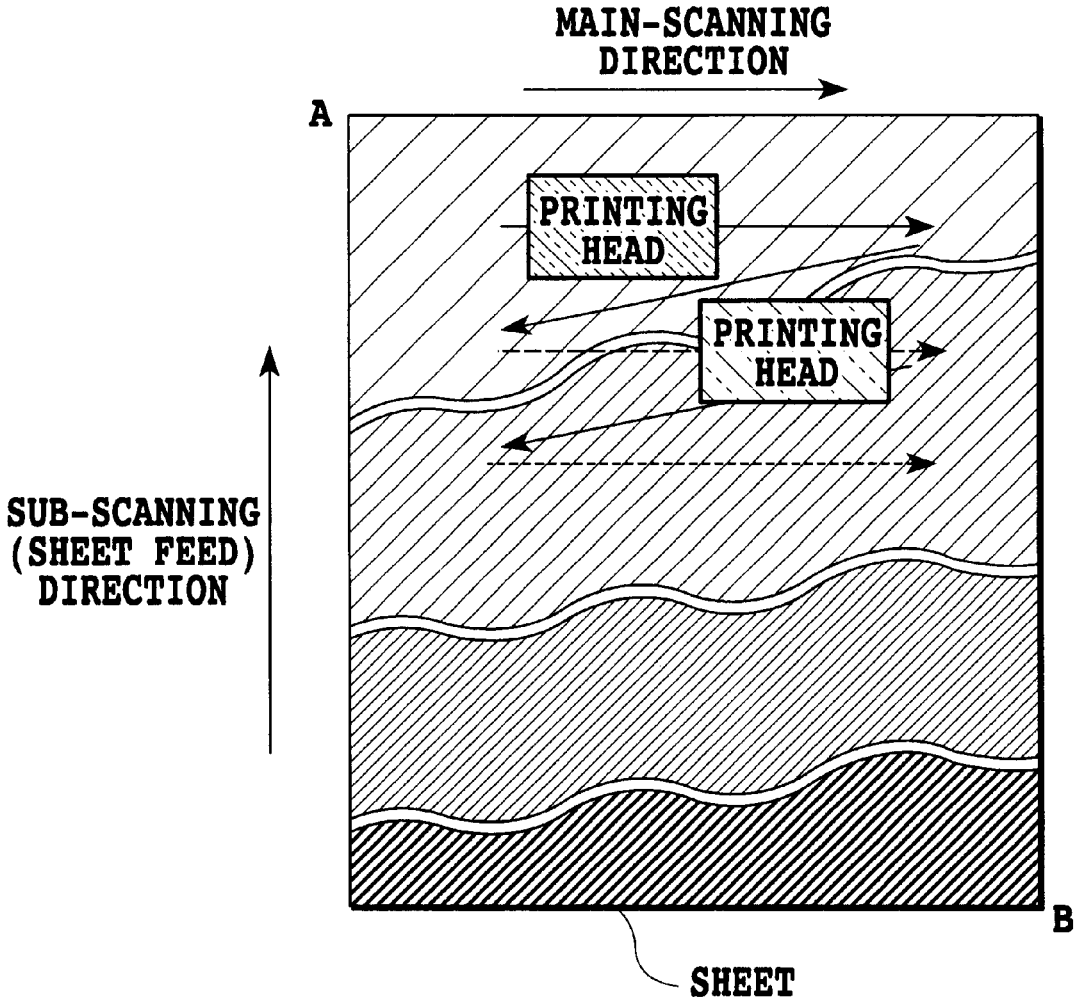
FIG. 2 is a diagram schematically showing another example of the density distribution observed when a plurality of gray patches for which R, G, and B data have the same value are arranged in matrix form within the same sheet.

As shown in FIGS. 1 and 2, when an ink jet printer is used to print a patch pattern, the density increases as the printing position is further from the printing start position in the main-scanning direction and in the sub-scanning direction. One of causes is that heat generated during a printing operation is accumulated in the printing head to increase the temperature thereof as shown in FIG. 11.

Figure 11:
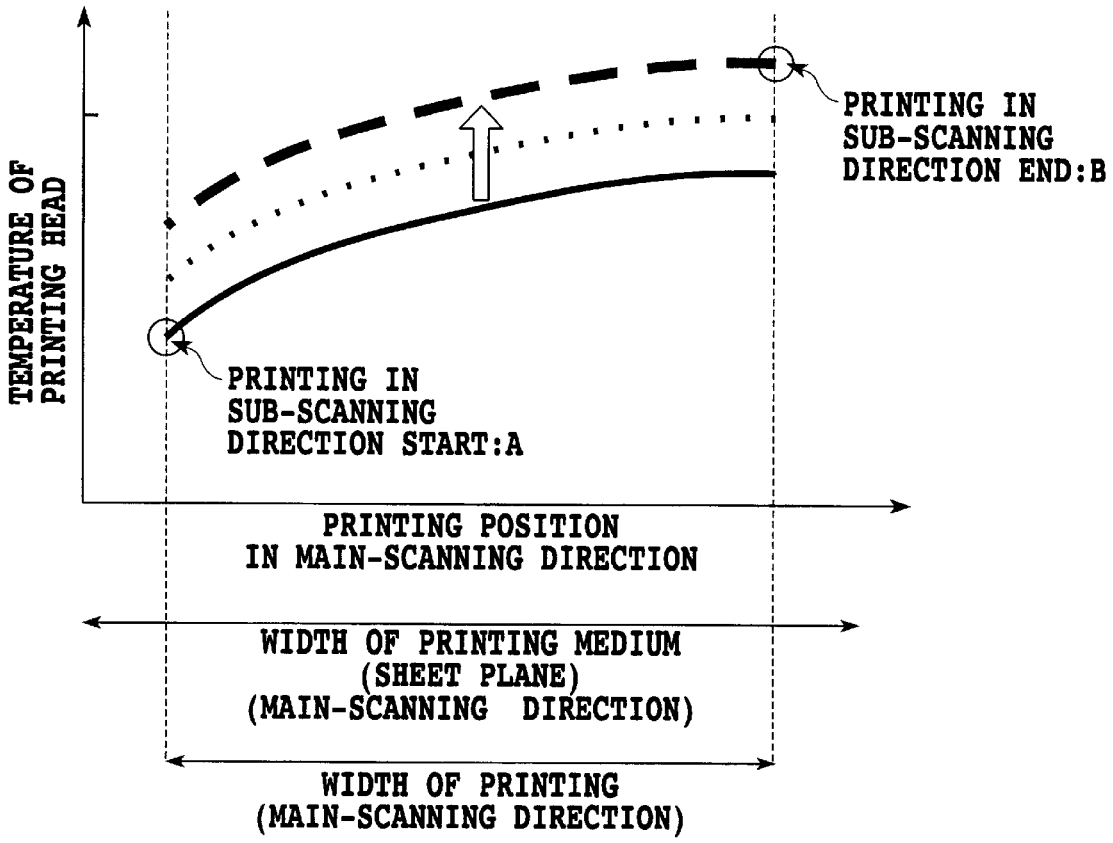
FIG. 11 is a graph illustrating a variation in temperature associated with a printing operation of the printing head.

FIG. 11 is a diagram showing a variation in temperature of the printing head observed when one page of a patch pattern is printed as shown in FIG. 1 or 2. A sub-scanning direction printing start position A and a sub-scanning direction printing end position B in FIG. 11 correspond to the positions A and B in FIGS. 1 and 2, respectively. As shown in FIG. 11, as printing is carried out in the main-scanning direction, the temperature of the printing head increases.

Further, although not apparent from this figure, also in the sub-scanning direction, the temperature increases. Furthermore, increasing of print density (increasing of ejection amount of ink) caused by the above increase of the head temperature differs between a nozzle of each of C, M, Y, K, lc, lm inks in accordance with the driving state for each of the nozzles of the inks.

Figure 14:
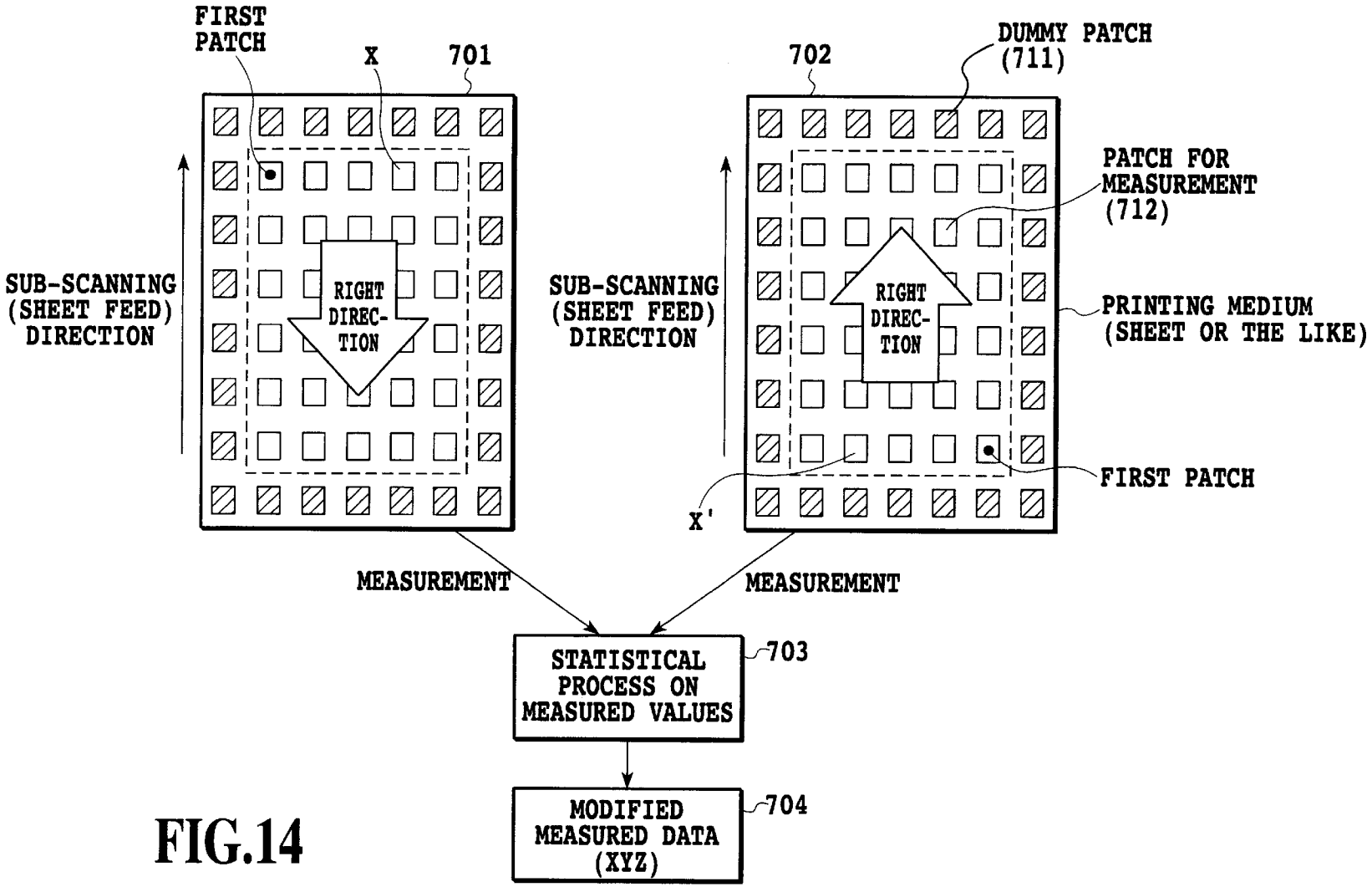
FIG. 14 is a diagram illustrating a process executed for the results of measurements of the patch pattern shown in FIG. 12 and a symmetrical patch pattern with respect to the center point of a sheet.
Figure 24:
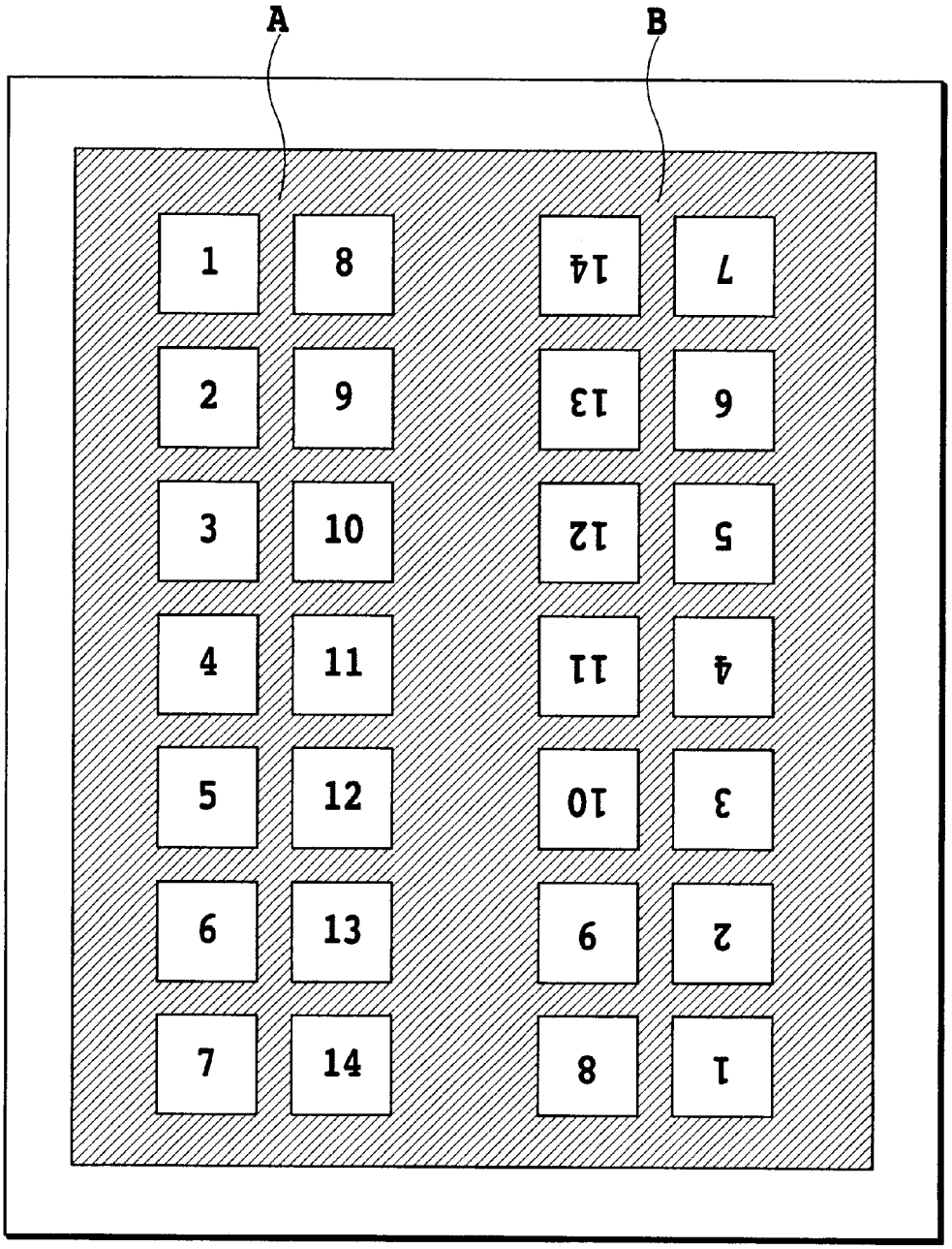
FIG. 24 is a diagram showing yet another example of a patch pattern.

In the present invention, in order to reduce the effect of print density variation caused by temperature variation of the printing head depending on printing positions on measured data for the patches, as shown in FIGS. 14 and 24, a combination of a patch pattern printed in a right direction for the sub scanning direction and a patch pattern printed in an opposite direction to the right direction is used. A processing for the measured data for the combination of the pattern is described later.

Further, in the case of using a printing medium having a width (the main scanning direction) size and a length (the sub scanning direction) size which is greater than the width size, such as A4 size sheet, the temperature difference depending on the print position is small in the main scanning direction and is great in the scanning direction. Accordingly, in the case that the patch pattern subject to a measurement includes a patch pattern for which the difference in the print density in the main scanning direction during the printing operation (a lengthwise direction) is small, for example, in the case that for a portion A shown in FIG. 24, the change in print density caused by the temperature difference of the printing head between respective No. 1 patch and No. 8 patch of the portion A is small, it is possible to form a set of a group of patches (the portion A) printed in the sub scanning direction and a group of patches (a portion B) printed in an opposite direction to the sub scanning direction for one sheet. FIG. 24 shows correspondence patches between A and B portions with the same number and an area including an area on which a dummy patch described later is printed with oblique lines.

In the example shown in FIG. 11, the temperature is lower at the left end of the temperature increase curve shown by the broken line, the left end corresponding to an intermediate position in the sub-scanning direction, than at the right end of the temperature increase curve shown by the solid line, the right end corresponding to the printing start position in the sub-scanning direction. This is because printing is carried out by causing the printing head to eject the ink only during scanning in one main-scanning direction (forward direction), while not causing them to eject the ink during movement in the opposite main-scanning direction (backward direction), so that the temperature of the printing head decreases during the backward scanning in which no ink is ejected. Such a temperature increase characteristic of the printing head depends on printing conditions such as print width (=the time during which the printing head is at rest with no ejection in the backward scanning), the types (colors) of inks ejected, or the amount of ink ejected. If, for example, printing is started from the left end of the sheet, the temperature of the printing head differs between the left and right ends of the sheet depending on an ink ejection condition. Consequently, the amount of ink ejected may increase or the concentration of dye in the ink may increase owing to an evaporation of the ink from the printing head of high temperature.

Figure 23:
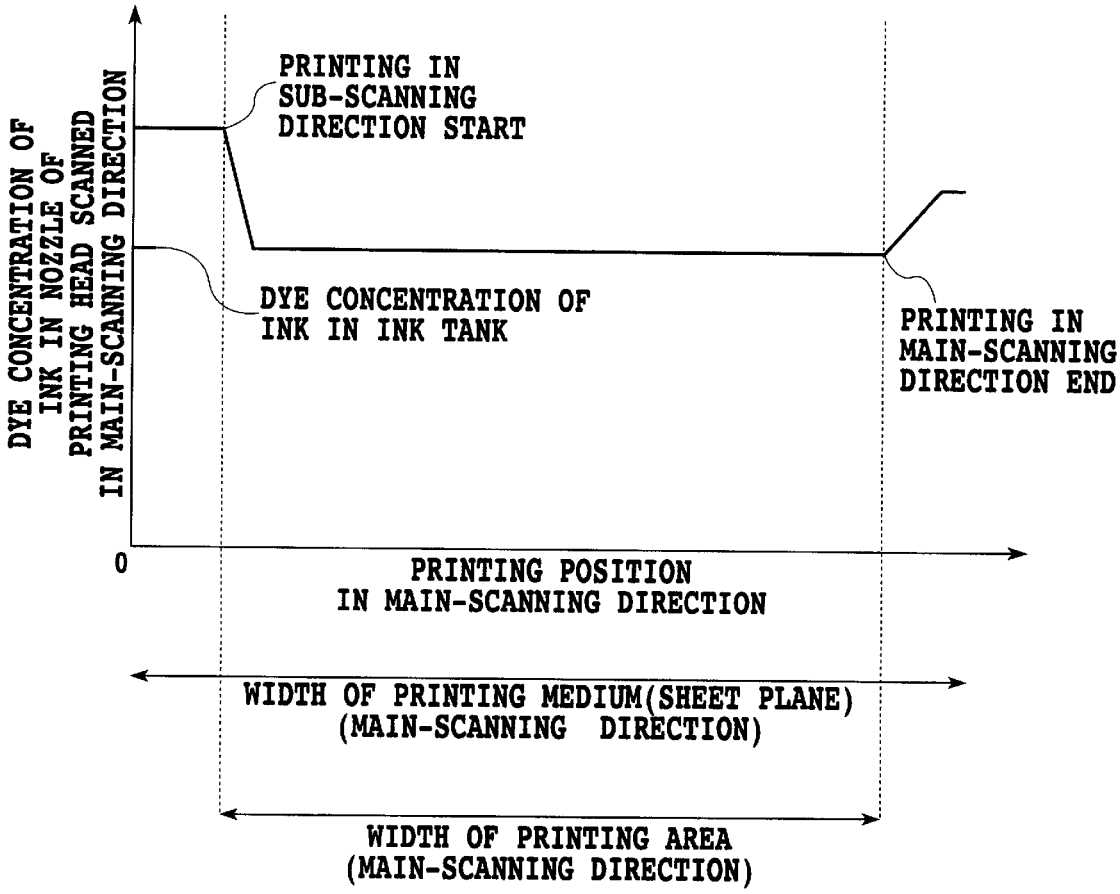
FIG. 23 is a graph illustrating a variation in dye concentration of ink in a nozzle of a printing head.

FIG. 23 is a diagram illustrating a relationship between printing sequence of the ink-jet printer and a characteristic of the dye concentration of ink in a nozzle of the printing head. FIG. 23 shows the relationship in a case that after long rest of printing with no ejection from the printing head, a printing operation of one scanning cycle has been executed. It is understood with the figure that the dye concentration of ink in the nozzle increases owing to the long rest of printing, the dye concentration is stabilized at a low value as the printing operation progresses in which fresh ink is supplied from an ink tank to change the ink in the nozzle with the fresh ink, and the dye concentration again increases due to the evaporation of ink when the printing operation ends at a state that temperature of the printing head is high due to a continuous printing operation. In the example shown in FIG. 23, the concentration at a print start point is greater than that after a printing operation of one scanning cycle because the time it takes for the solvent in the ink to evaporate during the long rest of printing is longer than that during the printing operation.

Therefore, color reproduction is unstable particularly at the ends of the sheet, compared to the center of the sheet.

Figure 4:
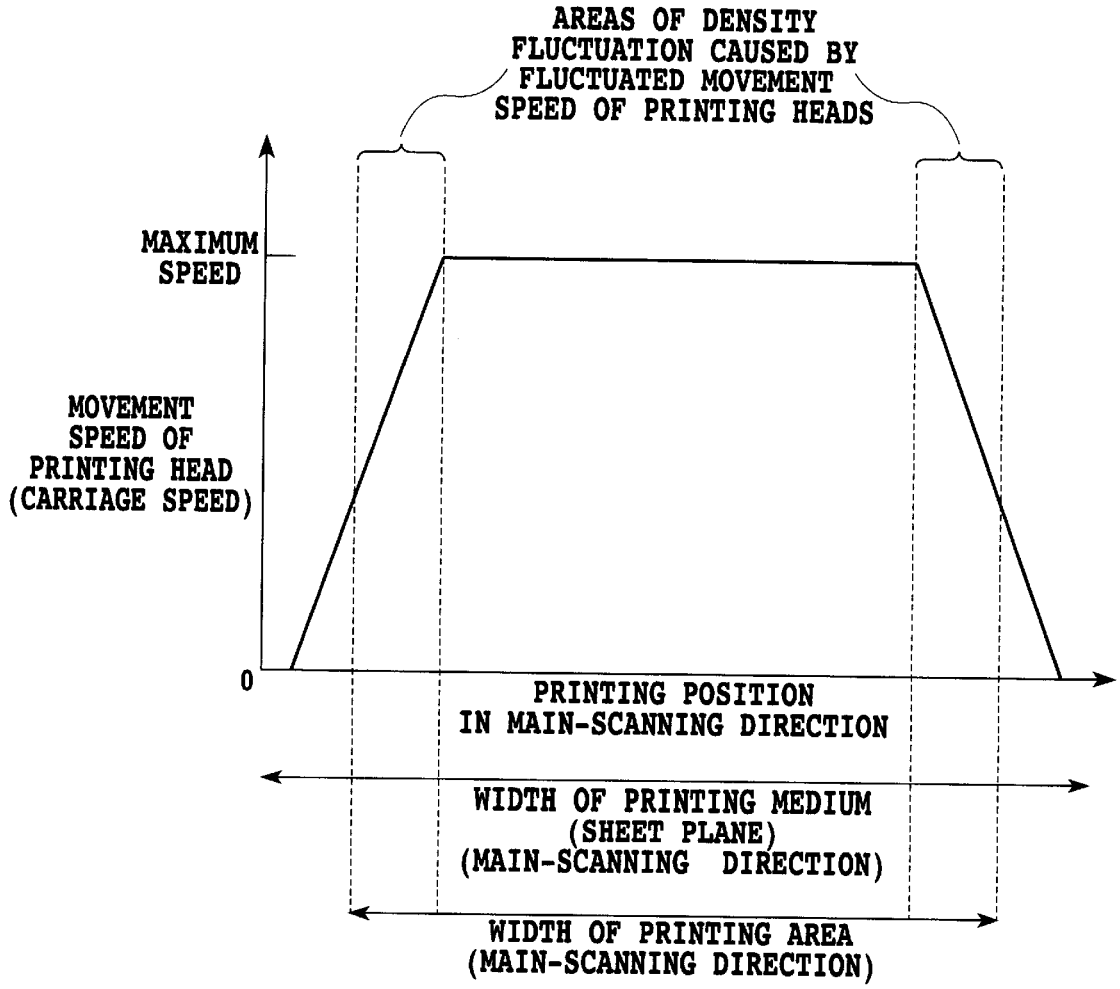
FIG. 4 is a graph illustrating a variation in speed of the printing head moved by a carriage.
Figure 5:
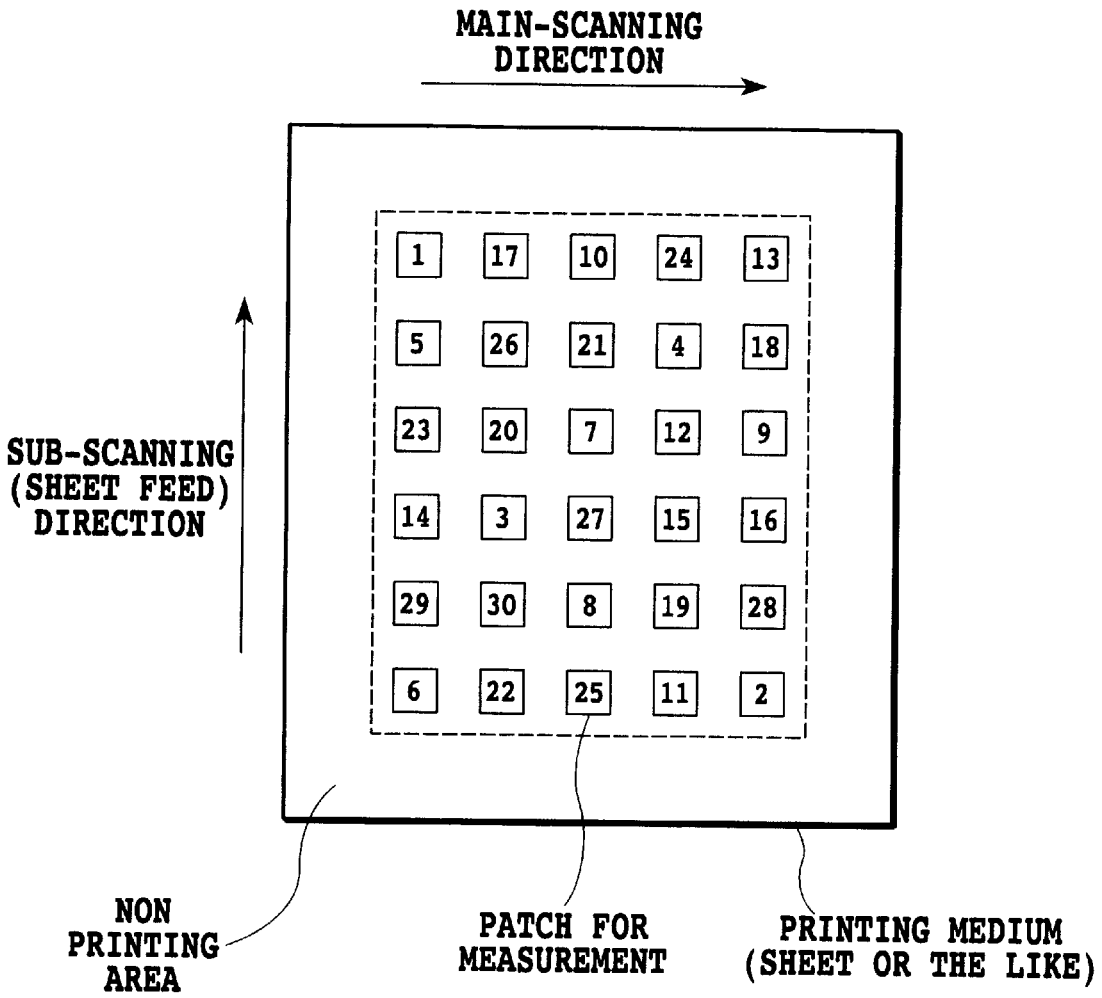
FIG. 5 is a diagram schematically showing a patch pattern according to a conventional example.

Further, as shown in FIG. 4, the printing density may differ between the center and end of a printing area because of a variation in movement speed of the printing head.

FIG. 4 is a diagram showing a change of the printing head in the main scanning direction with respect to print positions in the main scanning direction. As shown in FIG. 4, the printing head is accelerated from an area before the printing area (area in which the printing head is used for printing) through the end of the printing area, moves at constant speed in a middle portion of the printing area, and begins to decelerate from an area before another end of the printing area. Therefore, printing at respective end portions of the printing area may suffer from variation in print density due to the acceleration or deceleration of the printing head. In the above description with respect to FIG. 4, a term "end of printing area" is used in place of a term "end of sheet", because a serial printer such as an available ink jet printer moves the printing head in the main scanning direction between a home position and an area for which printing is to be executed, and does not always move the printing head over the full range of a width of a sheet. For example, when the printing area for which printing is to be executed is in an area of a home position side on the sheet, the printing head moves from the home position to the printing area, and returns to the home position from the far end of the printing area.

Figure 12:
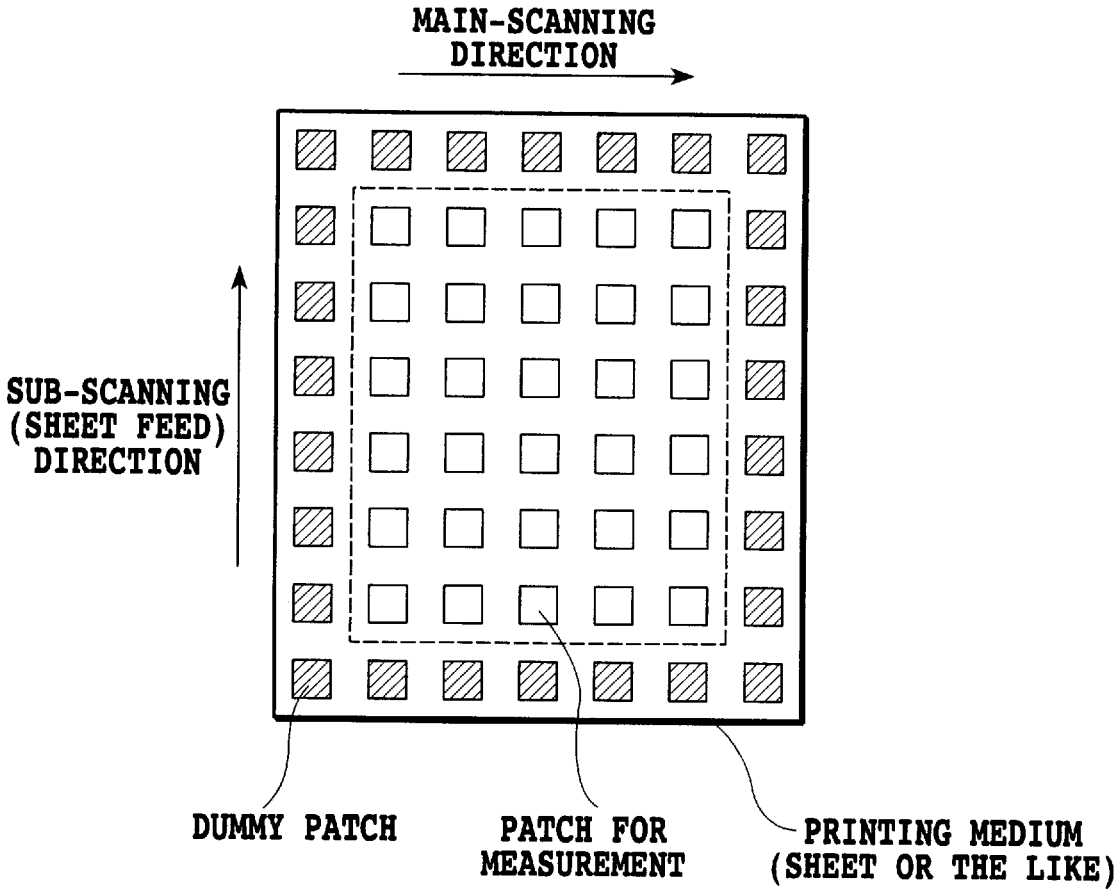
FIG. 12 is a diagram schematically showing a patch pattern according to an embodiment of the present invention.

Thus, in this embodiment, a test pattern (test image) such as the one shown in FIG. 12 is printed. That is, with this patch pattern, in addition to patches to be measured (measure images), dummy patches (dummy images) that are not measured are printed along the periphery of a sheet.

Printing the dummy patch allows the ink of the improperly increased dye concentration in the nozzle of the printing head to be discharged to stabilize the concentration of ink so that the print density can be stabilized.

Further, since the dummy patch is printed at positions corresponding to the "AREAS OF DENSITY FLUCTUATION CAUSED BY FLUCTUATED MOVEMENT OF PRINTING HEADS" shown in FIG. 4, the measure image is printed on an area in which the printing head moves at a constant speed so that the print density can be stabilized.

Actually, 729 patches consisting of nine data for each of the R, G, and B signals as described above are printed, but FIG. 12 shows fewer patches for simplification.

The arrangement of the patches to be measured is not limited. That is, the nine data for each of the R, G, and B signals, the manner of combining the data together, and the arrangement of a plurality of patches consisting of such combinations are not limited in applying the present invention. For example, 729 patches consisting of nine data for each of the R, G, and B signals may be randomly arranged as described in Japanese Patent Application Laid-open No. 7-209946 (1995), mentioned previously. However, the patch pattern printed in the sub scanning direction and the patch pattern printed in an opposite direction to the sub scanning direction must have respective arrangements such that the patch pattern of the opposite direction is a symmetrical pattern to the pattern of the sub scanning direction obtained by rotating the pattern of the sub scanning direction with respect to a certain point.

The above-described dummy patches are not measured and are printed by driving the printing heads so that the ink is ejected though all ejection openings in the respective printing heads for C, M, Y, K, lc, and lm. By thus printing the dummy patches by driving the printing heads so that the ink is ejected to the ends of the sheet or the periphery thereof through all ejection openings, all ejection openings including those which are not used during scanning for printing of measure patches are driven to print the dummy patches. Therefore, when the measured patches are printed, difference in temperature of ink in the nozzle of each ink can be made relatively small. Further, since the ink is ejected to the ends of the sheet or the periphery thereof through all ejection openings, the ink having high dye concentration due to vaporization of the solvent from the head is discharged from the nozzle. As a result, as described above, a difference in temperature for each nozzle and a variation in the dye concentration of the ink in the nozzle during the printing operation can be reduced when the measured patches are printed, thereby reducing a variation in patch density.

With the pattern shown in FIG. 12, particularly since a scanning operation (for the top side of the sheet in the figure) for printing only the dummy patches precedes a scanning operation for printing the measured patches, the temperature difference for each nozzle corresponding to each ink can be made small and the ink of improperly high dye concentration can be discharged from the nozzle, so that a stable printing of measure patches can be achieved. Further, the dummy patches (arranged along the right side of the sheet in the figure) are also printed at the end of the scanning operation for printing the measured patches. This may set the printing head to be in a condition for succeeding printing of another patch pattern on another sheet.

Further, at the ends of the scanning range, at which the dummy patches are printed, the movement speed of the printing head varies significantly as described previously. Thus, arranging the dummy patches in these areas allows printing of the measured patches to be avoided, and thus a variation in density attributed to the variation in speed described previously does not occur.

Figure 13:
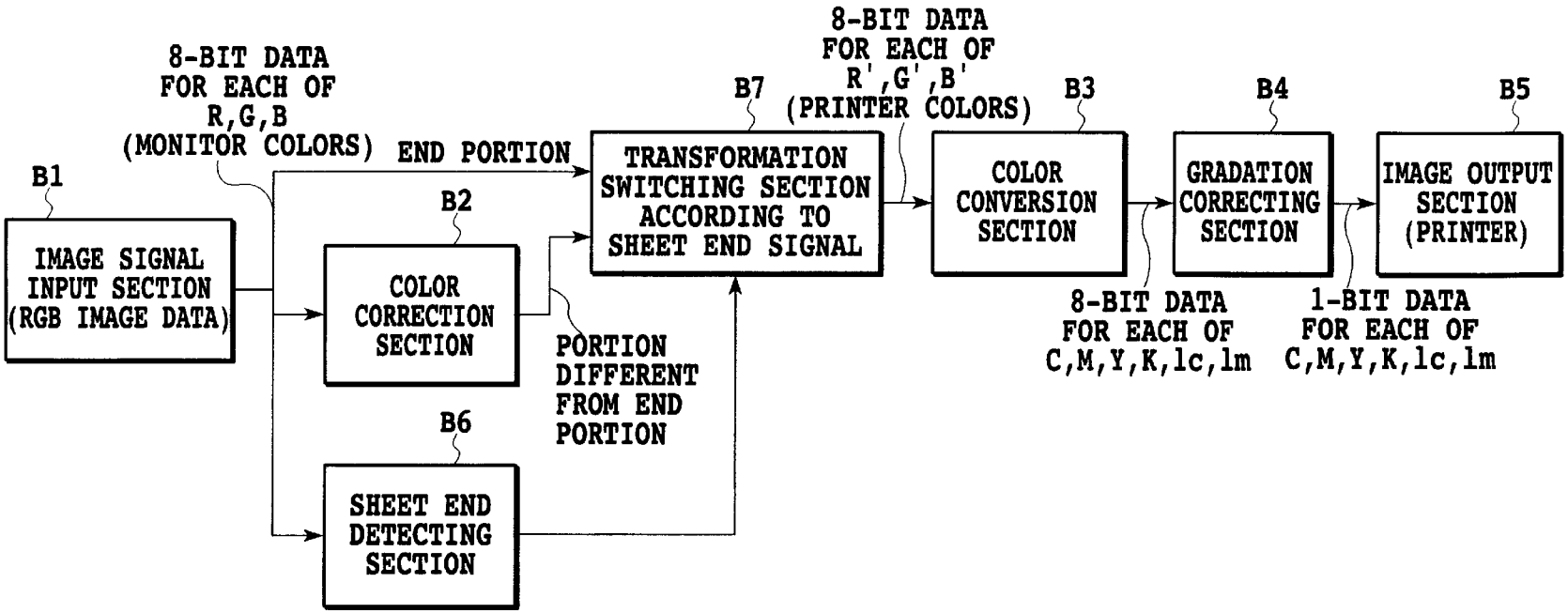
FIG. 13 is a block diagram similar to FIG. 9 and showing in detail the configuration of a printer correcting process section of the printer driver, shown in FIG. 7, the printer correcting process section being used for an image processing for patch pattern printing.

The dummy patches are printed by driving for all nozzles of each printing head as described above. For example, the print data in this case are signals output by the color conversion section B3 (see FIG. 9) and corresponding to C=M=Y=K=lc=lm=16. In this regard, in the image processing configuration shown in FIG. 9, RGB print data such as the dummy patch data in which the signals for all color inks have an equal value is often absent from a pre-post color process system such as the one discussed in this embodiment. That is, print data in which the signals for all color inks have an equal value is often absent from the range of the R', G', and B' signals output through a color matching process executed by the color correction section B2. Accordingly, in this embodiment, instead of the image process configuration shown in FIG. 9, the configuration shown in FIG. 13 is used to print a patch pattern. In FIG. 13, a sheet end detecting section B6 detects from attached data such as print positions in the sheet that a particular part of the patch pattern data is patch data printed at the ends (the periphery) of the sheet, that is, the dummy patches. In response to the resultant detection signal, a sheet end signal transformation switching section B7 carries out switching so as to transmit the dummy patch data sent directly from the image input section B1, to the color conversion section B3. Then, the color conversion section B3 uses a table such as the one shown in FIG. 3 to output the dummy patch data. That is, consequently, the pre-color-process table is generally based on a one-to-many correspondence such that all RGB values (24-bit full color) are assigned with the R'G'B' values, which are within a narrower range. Thus, a table is generated in which the signals for all colors C, M, Y, K, lc, lm have an equal value corresponding to this range of R'G'B' values, which are not found in the pre-color-process table. Further, when patch data is printed, this range of R'G'B' values, which are not found in the pre-color-process table, are transmitted to the printer. Then, the patches can be printed so that the signals for all colors C, M, Y, K, lc, lm have an equal value.

In the above-described example, the signal values for the dummy patch data are such that all printing heads for the respective color inks are driven. However, if, for example, any of the printing heads has its temperature varying markedly and this is known, the signal values may be such that only the printing head for the other color inks is driven.

Further, even by printing gray lines in which R, G, and B data have the same value, the ejection openings for a plurality of colors can be driven. In such a case, the dummy patches may simply be gray or have a low saturation. In this case, a table is created on a condition that gradation and granularity do not vary rapidly or the like.

In this embodiment, in addition to the patch pattern shown in FIG. 12, a patch pattern is printed such that respective data of these two patch patterns are arranged symmetrically with respect to the center of the sheet. Then, these two patch patterns are measured as shown below, so that calibration is executed on the basis of the results of the measurements.

(Processing of Measured Data)

As described previously in FIGS. 1 and 2, a variation in density caused by an increase in temperature of the printing heads tends to increase as the print position in the sheet moves rightward and downward from the upper left end A, which is the start position of printing the patch pattern. Further, the variation in density tends to be maximum at the lower right end B of the pattern.

Thus, as shown in FIG. 14, a patch pattern 701 (shown in FIG. 12) is printed in a right direction by scanning the printing heads in the main-scanning direction and scanning the sheet (feeding the sheet) in the sub-scanning direction and colorimetric data for each patch in the patch pattern 701 is obtained. Also, a patch pattern 702 is printed in an opposite direction to the right direction similarly, based on patch data which is obtained by rotating the patch data for the patch pattern 701 through 180° around the center of the sheet (the center of a patch array to be printed), and colorimetric data for each patch in the patch pattern 702 is obtained. The colorimetric data of patches located at the corresponding positions (corresponding positions x, x' in the two patch arrangement shown in FIG. 14) of both patterns are averaged (703). These averages are used as modified colorimetric data 704. By using the above-described colorimetric instrument, the modified colorimetric data is obtained as data D2 (see FIG. 10) for the L*a*b* space, which is a device non-dependent space.

Figure 15:
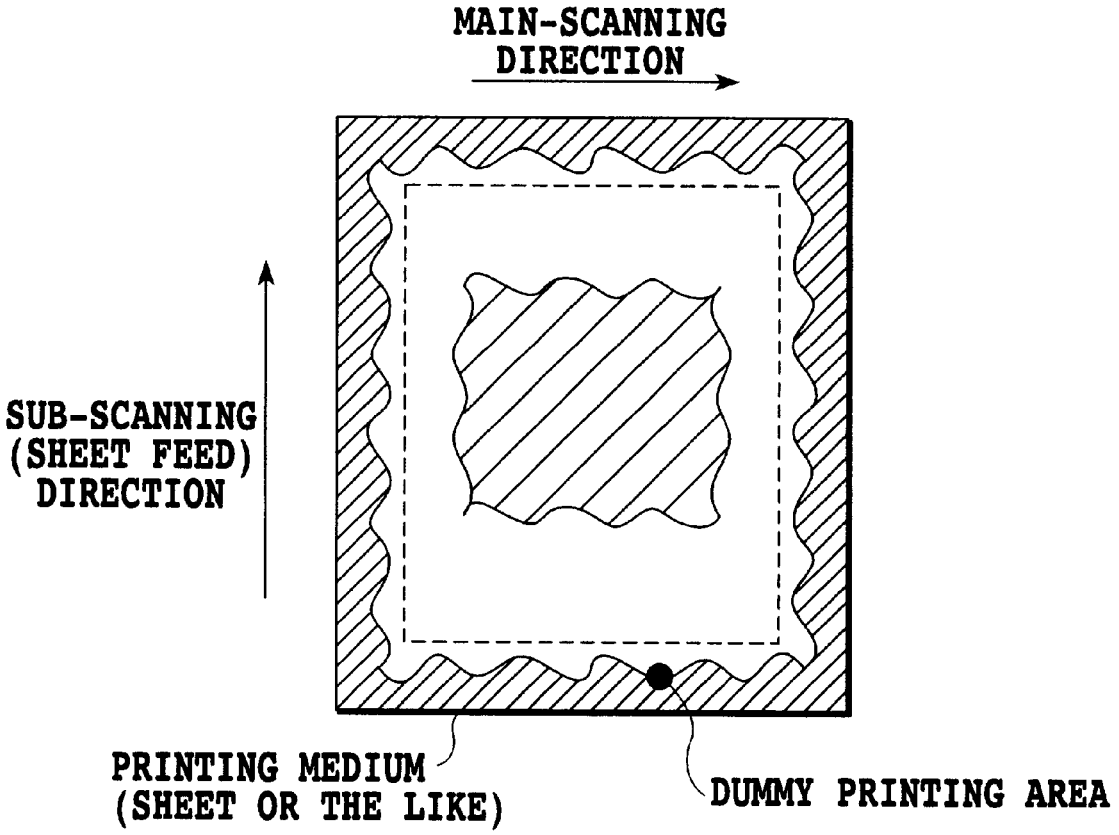
FIG. 15 is a diagram showing the results of the process shown in FIG. 14 and illustrating that the results involve less uneven density.

Such modified colorimetric data allows the nonuniform density caused by increase of the temperature of the printing head within the same sheet to be averaged to provide measured data with more uniform density within the same sheet as shown in FIG. 15.

Gamut Mapping: Transformation of Monitor L*a*b* Space Data into Printer Target

Figure 16:
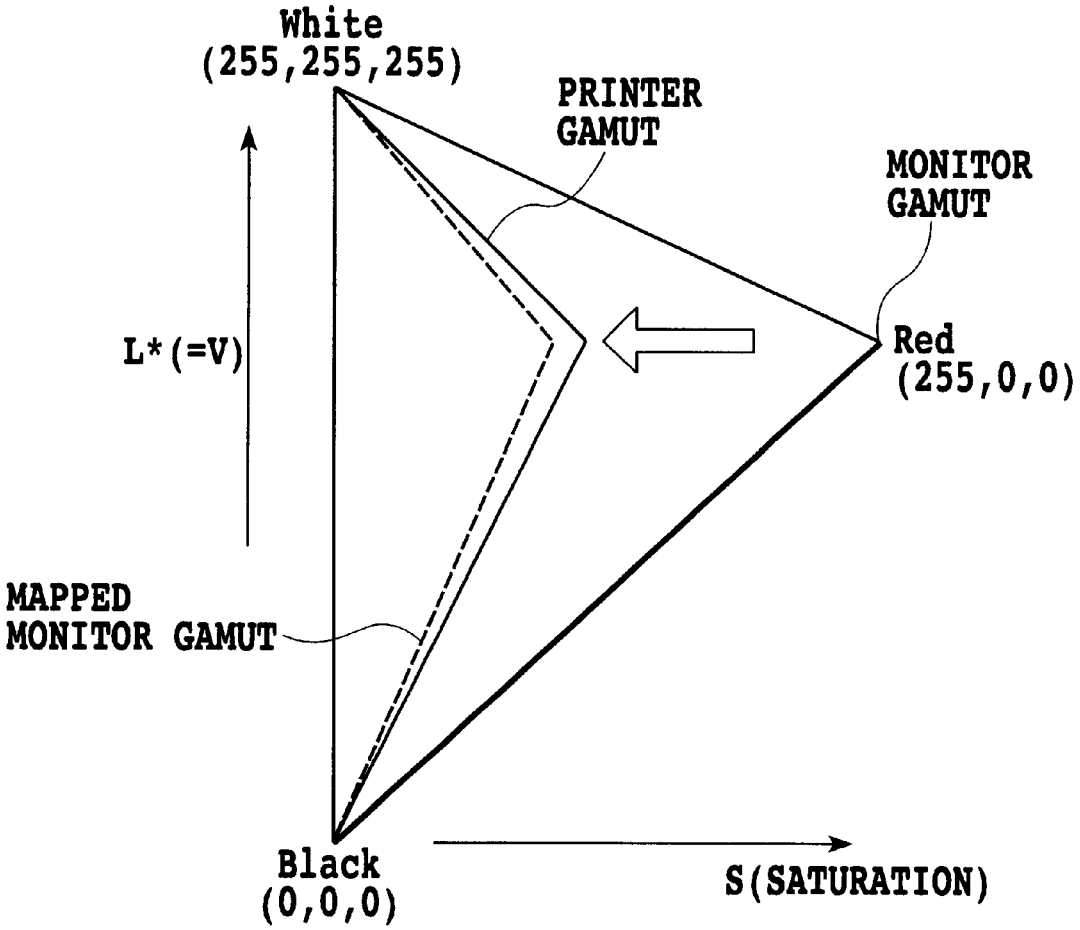
FIG. 16 is a diagram showing examples of color reproduction ranges of a printer and a monitor and illustrating gamut mapping therefor.

FIG. 16 is a diagram showing examples of color reproduction ranges of the printer and monitor.

As shown in this figure, in the L*a*b* space, the gamut (whole area) of the RGB values for the monitor is larger than the gamut of the R'B'G' values for the printer in terms of both L* and saturation. Accordingly, simply associating these values with each other in the L*a*b* space does not allow the printer to print appropriate colors for all combinations of RGB data which can be displayed on the monitor. Thus, gamut mapping is carried out to provide printer outputs with colors similar to those of the monitor display, though the corresponding L*a*b* values do not precisely equal each other.

Specifically, the gamut of the RGB data for the monitor in the L*a*b* space is compressed by, for example, reducing the saturation S (=sqrt (a*×a*+b*×b*) while maintaining brightness L*, as shown in FIG. 16. This mapping provides a transformation of an L*a*b* space data D4 for the monitor into an L*a*b* space data D5 for the printer target, as shown in FIG. 10. Thus, data D5 of the L*a*b* space for the printer target, obtained by this transformation, can lie within the R'B'G' gamut for the printer (mapped monitor gamut).

Generation of LUT for Color Correction Section: Association of Monitor RGB Data (D3) with Printer R'G'B' Data (D11)

The above-described gamut mapping adjusts the printer target L*a*b* data (D5) so that this data lies within the printer R'B'G' gamut (D2). More specifically, in FIG. 10, data D3, which consists of 9×9×9 RGB signals for the monitor and is used to print the patch pattern in FIG. 12, is transformed into data D5 of L*a*b* space for the monitor using a predetermined calculation described previously (P1). Further, the transformed data D5 of the L*a*b space for the monitor is associated with data D11 of printer D'B'G' through transformation routes P2→P3→P4→P5.

For the respective points (L*, a*, b* values) determined by data D5 of the printer target, which has been transformed so as to lie within the printer gamut, a transformation of L*a*b into R'G'B' (P4 and P5) is performed. This transformation relationship is determined as follows: as described previously, on the basis of the relationship between data D11 of the printer R'G'B' and data D2 of the printer L*a*b*, which is obtained as modified measured data by measuring patches printed on the basis of the data D11, the transformation relationship L*a*b*→R'G'B' is determined. Then, for this relationship, for example, an interpolation space of a tetrahedron is constructed using the points of the data D2, so that the points of data D5 of the printer target L*a*b are subjected to an interpolation operation to determine the corresponding printer R'B'G' data. Those points which cannot be accommodated within the interpolation space are found by extrapolation. The L*a*b→R'G'B' transformation can be achieved by inverse tetrahedron interpolation or a transformation method of constructing a printer model using a neural network or a multiple regression equation.

As described above, by sequentially executing the processes included in the transformation routes P1→P2→P3→P4→P5, the relationship between data D3 of the monitor RGB and data D11 of the printer R'B'G', i.e. the LUT D12 of the color correction section is obtained. This provides a color matching profile based on the patch pattern.

[Second Embodiment]

This embodiment relates to a configuration substantially similar to that of the first embodiment, described above. Description of the same elements of the configuration is omitted.

This embodiment relates to another embodiment of dummy patches printed at the ends or the periphery of the sheet.

Figure 17:
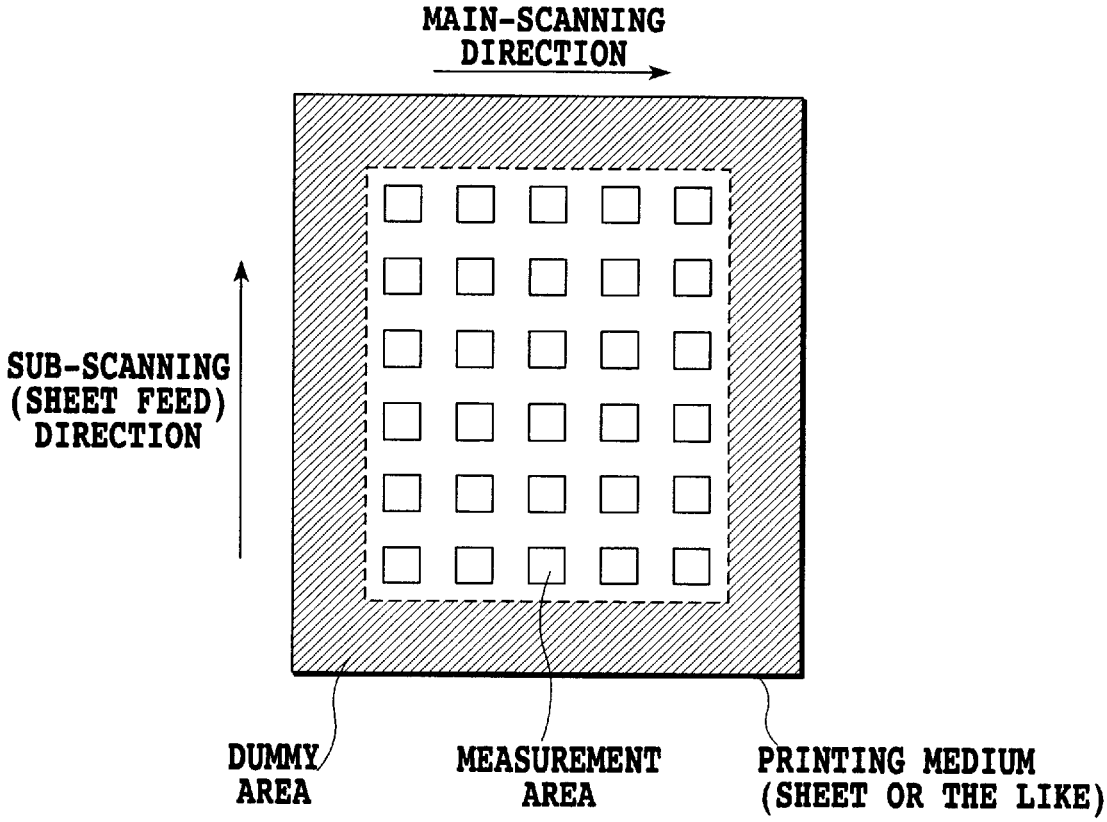
FIG. 17 is a diagram showing a patch pattern for another embodiment of the present invention.

FIG. 17 shows an example of a patch pattern, wherein instead of the use of dummy patches, the entire area around the periphery of the area in which measurement patches are printed is printed. This pattern produces effects similar to those described in FIG. 12, i.e., reduces a variation in density or the non-uniformity of density.

Figure 18:
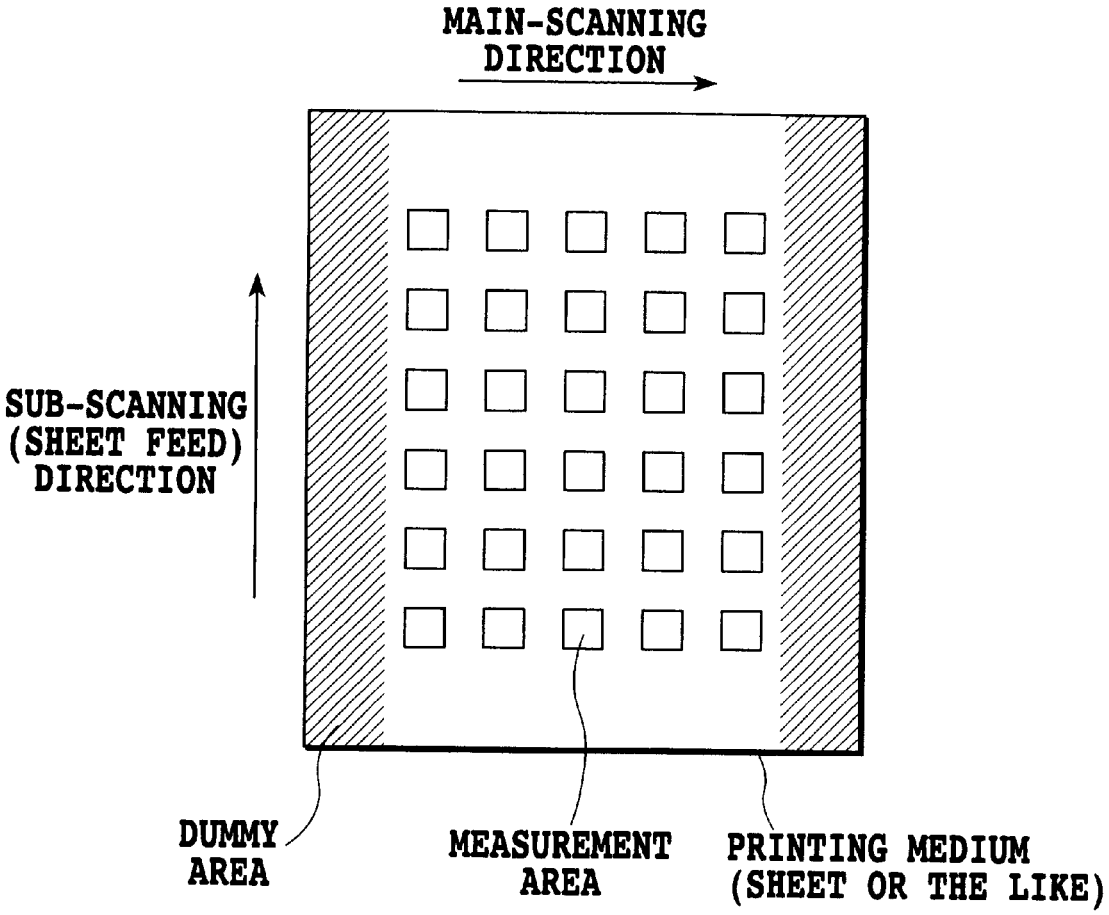
FIG. 18 is a diagram showing yet another example of a patch pattern.
Figure 19:
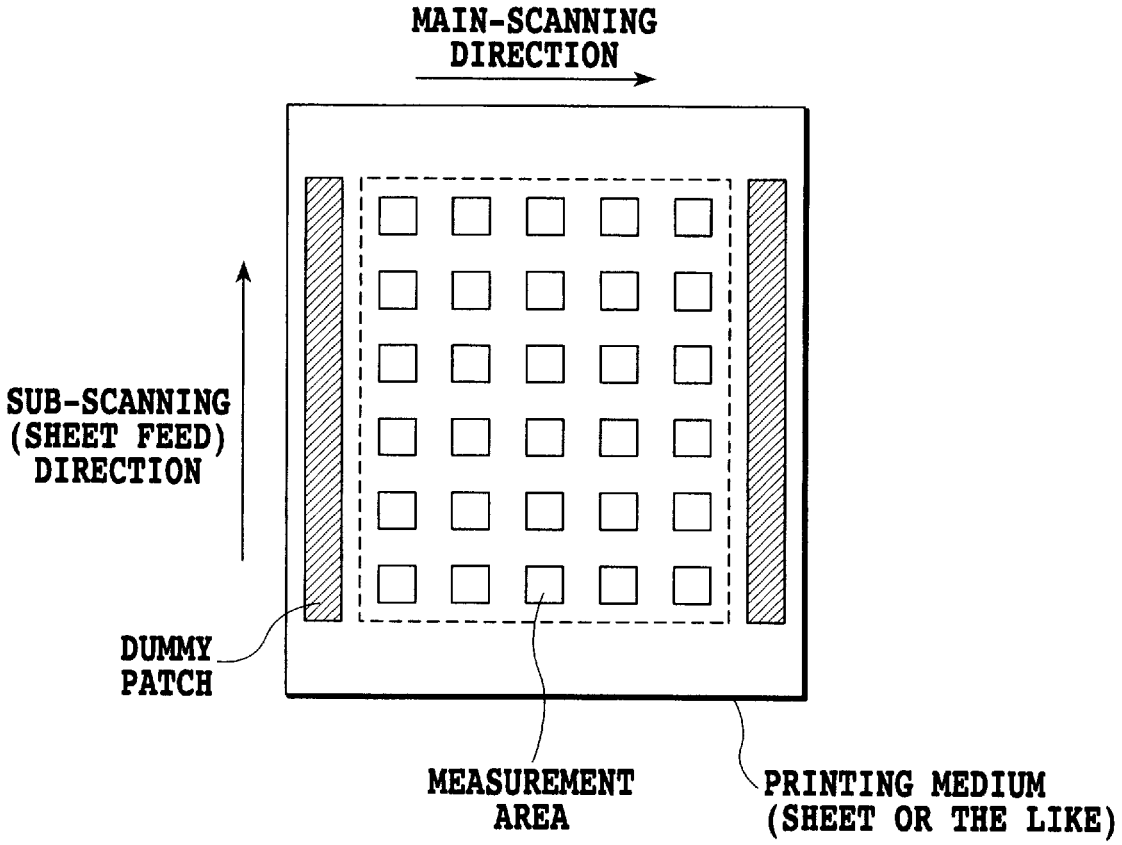
FIG. 19 is a diagram showing yet another example of a patch pattern.

In another example, the patch pattern shown in FIG. 18 or 19 can be printed. This arrangement is effective because the operation (scanning) of printing only dummy patches in a particular scan can be omitted, in the case of using a printing head in which the temperature sufficiently increases by printing the dummy patches immediately before the measured patches in a scanning operation for printing the measured patches and becomes stable.

Figure 20:
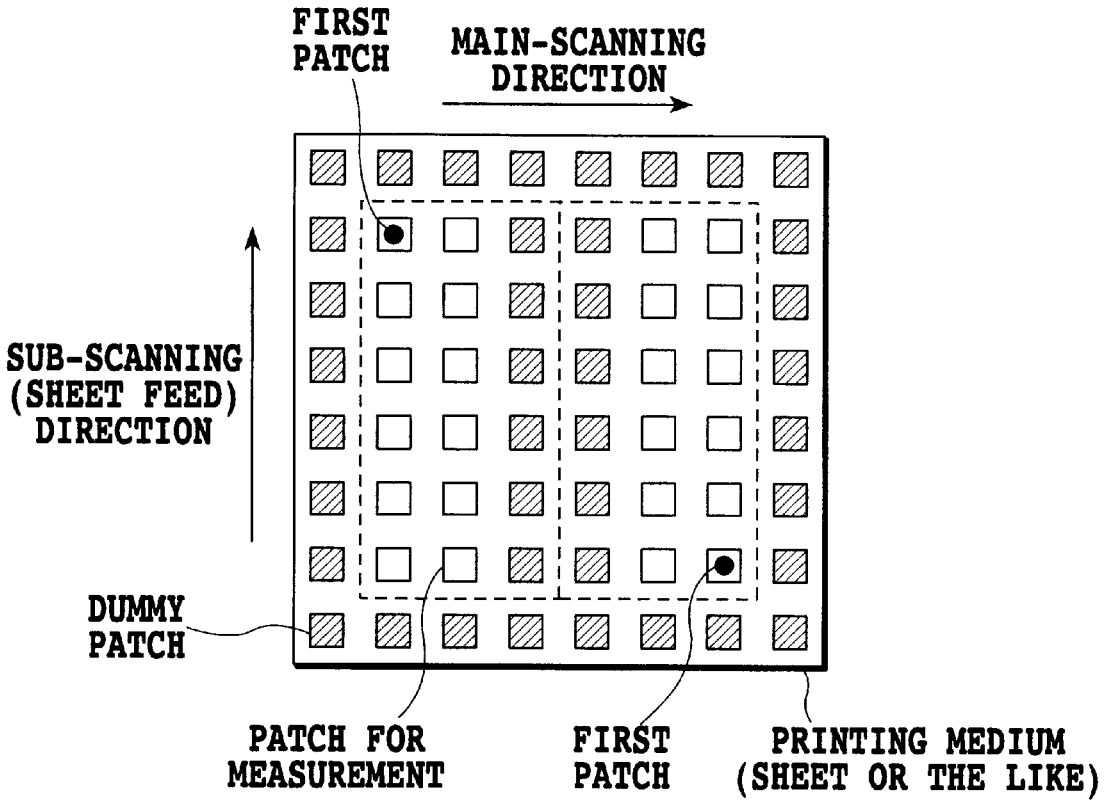
FIG. 20 is a diagram showing a patch pattern according to yet another embodiment of the present invention.

As another example, FIG. 20 is a diagram showing a patch pattern that serves to simplify processing of measured data.

In the first embodiment, as described in FIG. 14, two point-symmetrical patch patterns are printed, and the averages of the corresponding patches of both patterns are taken, thereby eliminating the effects of non-uniform density caused by a variation in temperature. In contrast, the patch pattern shown in FIG. 20 allows the above-described point-symmetrical patterns to be printed on a single sheet during a single printing operation.

Thus, measuring only one sheet results in colorimetric data on patches output in the right direction and on patches printed on the basis of data obtained by rotating the first patches through 180° around the center of the sheet.

[Third Embodiment]

Figure 21:
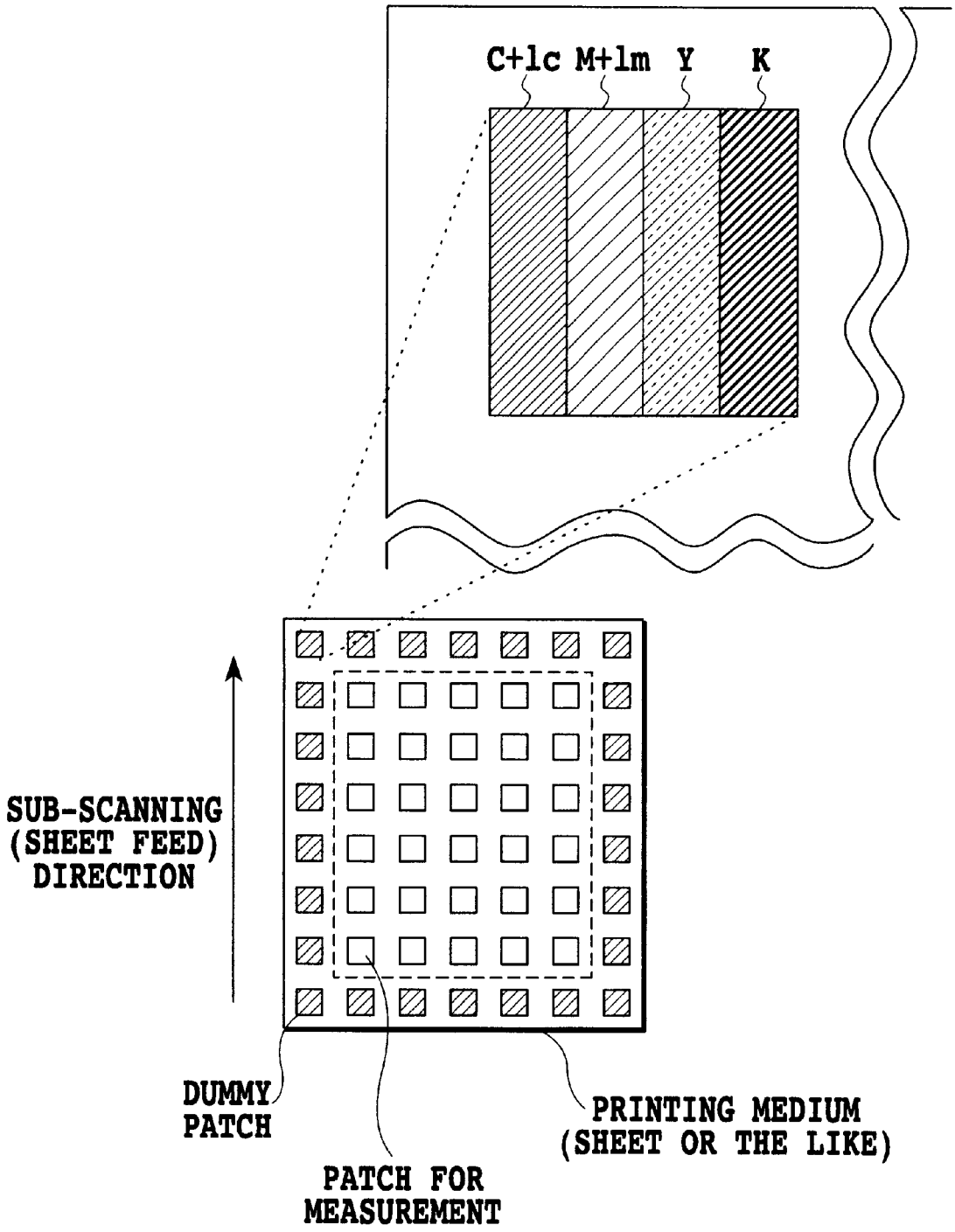
FIG. 21 is a diagram showing a patch pattern according to still another embodiment of the present invention.

In this embodiment, the dummy patches are configured as shown in FIG. 21. Thus, without the configuration exclusively used to output dummy patches as shown in FIG. 13 in the first and second embodiments, for example, the signal values for the dummy patches shown as shaded areas in FIG. 21 can be set so that the nozzles corresponding to the colors C, M, Y, K, lc, lm are driven substantially equally.

In the above-described embodiments, the dummy patches are actually printed on the print sheet. However, similar effects can be produced even if the dummy patches are not actually printed on the print medium. For example, the ink may be ejected onto a preliminary ejection receiver (not shown) of the recovery unit 400, shown in FIG. 8. Alternatively, instead of actually ejecting the ink, a signal may be provided to drive ejection heaters to the extent that ejection will not occur.

Furthermore, in the above-described embodiments, the device uses thermal energy to change the state of the ink to thereby eject ink droplets through the ejection openings so that dots are formed on the print sheet to print an image thereon. However, it is evident from the above description that similar effects can be produced with any serial printer.

[Other Embodiments]

As described above, the present invention may be applied to a system composed of plural pieces of equipment (for example, a host computer, interface equipment, a reader, and a printer) or an apparatus consisting of a single piece of equipment (for example, a copier or a facsimile machine).

Further, it is also within the scope of the present invention to supply program codes for software designed to implement the functions of the embodiments described previously, to a computer in an apparatus or system connected to various devices to operate them so as to implement the functions of the embodiments described previously, and to cause the computer (CPU or MPU) in the system or apparatus to operate the devices according to the stored program.

In this case, the program codes for the software themselves implement the functions of the embodiments described previously. The present invention is constituted by the program codes themselves and means for supplying the program codes to the computer, for example, a storage medium storing them.

The storage medium storing such program codes may be, for example, a floppy disk, a hard disk, an optical disk, a photomagnetic disk, a CD-ROM, a magnetic tape, a non-volatile memory card, or a ROM.

Further, it is needless to say that the program codes are included in the embodiments of the present invention not only if the computer executes the supplied program codes to implement the functions of the embodiments described previously, but also if the program codes cooperate with an OS (operating system) running in the computer in implementing the functions of the embodiments described previously.

Of course, it is also within the scope of the present invention that the supplied program codes are stored in a memory installed in an expanded board in the computer or an expanded unit connected to the computer, and on the basis of instructions from the program codes, a CPU or the like installed in the expanded board or unit executes a part or all of an actual process to implement the functions of the embodiments described previously.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

As described above, according to the embodiments of the present invention, a test image used for calibration includes measure images to be measured and dummy images that are not measured. The dummy images are printed on at least a part of a periphery of a printing medium, which is located around the area on which the measure images are printed. Accordingly, before the measure images are printed, printing of the dummy images can be performed to precisely reduce and stabilize a variation in density of patches in a patch pattern caused by a variation in a moving speed of a printing head in the printing operation and a variation in dye concentration of ink in a nozzle of the printing head. More specifically, in a system including also a serial printer in which the printing head moves only on a part of a scanning area for which ejection data is present when performing a scanning operation, printing of the dummy image allows the speed change of the printing head to be shifted to a constant speed area during printing the dummy image to stabilize the speed on printing the measure images. Further, as to the variation in dye concentration of ink in the nozzle of the printing head, since ink in the nozzle is removed by printing of the dummy patch before printing the measure images, the dye concentration of ink can be made constant during printing the measure images. Thereby, a variation in printing density can be reduced, which results from the variations in temperature of the printing head and in dye concentration on printing the measure images. Furthermore, printing of the dummy image can avoid change in a mix ratio of C, M, Y, K inks for printing the measure images, which is caused by mixing of different type inks near the ejection openings of the printing head.

According to a further preferred embodiment, the test image is such that the dummy images are printed at the opposite ends of a single scanning range of the printing head and the measure images printed so as to be sandwiched between the dummy images printed at the opposite ends. Accordingly, when the test image is printed by scanning the printing head, the measure images can be prevented from being printed at the opposite ends of the scanning range, where the speed may vary in connection with the scanning movement. This also hinders a variation in printing density of the measure images attributed to a variation in speed.

As a result, a test image, which allows a measurement thereof to be executed with precisely reducing an effect of a variation in density of the test image such as a patch pattern, which is caused by a variation in moving speed of a printing head and a variation in temperature of the printing head, can be printed for a calibration.

What is claimed is:

1. A calibration apparatus for outputting test image data to cause a printing apparatus to print a test image used for a calibration for said printing apparatus, wherein the test image includes a measure image which is a subject of a measurement and a dummy image which is not a subject of the measurement, and the dummy image is printed at least at a part of a periphery of an area on which the measure image is printed, on a printing medium.

2. A calibration apparatus as claimed in claim 1, wherein the printing apparatus repeats scanning of a printing head relative to the printing medium and transporting of the printing medium by a predetermined amount in a direction different from a direction of the scanning of the printing head so as to print the test image, and the test image includes the dummy image printed at both ends of a scanning range of one scanning of the printing head and the measure image printed so that the measure image is positioned between portions of the dummy image at the respective ends.

3. A calibration apparatus as claimed in claim 2, wherein the test image includes the dummy image printed over a whole scanning range of the scanning including a first scanning for printing the test image.

4. A calibration apparatus as claimed in claim 2, wherein the printing head ejects ink for printing.

5. A calibration apparatus as claimed in claim 4, wherein the printing head uses thermal energy for generating a bubble so as to eject ink.

6. A calibration apparatus as claimed in claim 1, wherein the printing apparatus, based on the test image data, prints a pair of test image portions which include respective measure image portions whose print positions on the printing medium are symmetrical to each other with respect to a center of an arrangement of the measure image.

7. A calibration apparatus as claimed in claim 6, wherein the pair of the test image portions is printed on one printing medium.

8. A calibration apparatus as claimed in claim 6, comprising means for, based on a result of the measurement of the measure image in the test image, correcting a process of an image processing section for a generation process for printing data used in the printing apparatus to execute a calibration process, said means executing the calibration process based on a statistical result of respective measurements of the measure image portions of the pair of the test image portions.

9. A calibration apparatus as claimed in claim 1, wherein the printing apparatus comprises a plurality of printing heads corresponding to a plurality of print colors, respectively, and in order to output the test image data to use all of the plurality of the printing heads when printing the dummy image, a processing for generating dummy image data is made different from a processing for generating measure image data.

10. A calibration apparatus as claimed in claim 1, wherein the printing apparatus comprises a plurality of printing heads corresponding to a plurality of print colors, respectively, and a processing for generating dummy image data is executed to output the test image data to use one of the plurality of the printing heads when printing the dummy image.

11. A calibration apparatus as claimed in claim 1, wherein the printing apparatus comprises a plurality of printing heads corresponding to a plurality of print colors, respectively, and the dummy image is formed with a plurality of colors printed by the plurality of printing heads.

12. An ink jet printing apparatus which uses a printing head ejecting ink to print a test image used for a calibration, wherein when printing the test image, ink ejection is executed from the printing head on an area other than an area on which the test image is printed.

13. An ink jet printing apparatus as claimed in claim 12, wherein the printing head uses thermal energy for generating a bubble so as to eject ink.

14. A calibration method including a process for outputting test image data to cause a printing apparatus to print a test image used for a calibration of the printing apparatus, wherein the test image includes a measure image which is a subject of a measurement and a dummy image which is not a subject of the measurement, and the dummy image is printed at least at a part of a periphery of an area on which the measure image is printed, on a printing medium.

15. A calibration method as claimed in claim 14, wherein the printing apparatus repeats scanning of a printing head relative to the printing medium and transporting of the printing medium by a predetermined amount in a direction different from a direction of the scanning of the printing head so as to print the test image, and the test image includes the dummy image printed at both ends of a scanning range of one scanning of the printing head and the measure image printed so that the measure image is positioned between portions of the dummy image at the respective ends.

16. A calibration method as claimed in claim 15, wherein the test image includes the dummy image printed over a whole scanning range of the scanning including a first scanning for printing the test image.

17. A calibration method as claimed in claim 14, wherein the printing apparatus, based on the test image data, prints a pair of test image portions which include respective measure image portions whose print positions on the printing medium are symmetrical to each other with respect to a center of an arrangement of the measure image.

18. A calibration method as claimed in claim 17, wherein the pair of test image portions is printed on one printing medium.

19. A calibration method as claimed in claim 17, comprising a step of, based on a result of the measurement of the measure image in the test image, correcting a process of an image processing section for a generation process for printing data used in the printing apparatus to execute a calibration process, said step executing the calibration process based on a statistical result of respective measurements of measure image portions of the pair of the test image portions.

20. A calibration method as claimed in claim 14, wherein the printing apparatus comprises a plurality of printing heads corresponding to a plurality of print colors, respectively, are in order to output the test image data to use all of the plurality of the printing heads when printing the dummy image, a processing for generating dummy image data is made different from a processing for generating measure image data.

21. A calibration method as claimed in claim 14, wherein the printing apparatus comprises a plurality of printing heads corresponding to a plurality of print colors, respectively, and a processing for generating dummy image data is executed to output the test image data to use one of the plurality of the printing heads when printing the dummy image.

22. A calibration method as claimed in claim 14, wherein the printing apparatus comprises a plurality of printing heads corresponding to a plurality of print colors, respectively, and the dummy image is formed with a plurality of colors printed by the plurality of printing heads.

23. A calibration method including a process for outputting test image data to cause a printing apparatus to print a test image used for a calibration of the printing apparatus, wherein the printing apparatus uses a printing head ejecting ink to print the test image, and when printing the test image, ink ejection is executed from the printing head on an area other than an area on which the test image is printed.

24. A printing medium including a test image printed thereon, the test image being used for a calibration of a printing apparatus, wherein the test image includes a measure image which is a subject of a measurement and a dummy image which is not a subject of the measurement, and the dummy image is printed at least at a part of a periphery of an area on which the measure image is printed, on a printing medium.

25. A printing medium as claimed in claim 24, wherein the printing apparatus repeats scanning of a printing head relative to the printing medium and transporting of the printing medium by a predetermined amount in a direction different from a direction of the scanning of the printing head so as to print the test image, and the test image includes the dummy image printed at both ends of a scanning range of one scanning of the printing head and the measure image printed so that the measure image is positioned between portions of the dummy image at the respective ends.

26. A printing medium as claimed in claim 25, wherein the test image includes the dummy image printed over a whole scanning range of the scanning including a first scanning for printing the test image.

27. A printing medium as claimed in claim 24, wherein a pair of test image portions is printed which include respective measure image portions whose print positions on the printing medium are symmetrical to each other with respect to a center of an arrangement of the measure image.

28. A printing medium as claimed in claim 27, wherein the pair of the test image portions is printed on one printing medium.

29. A printing medium as claimed in claim 24, wherein the printing apparatus comprises a plurality of printing heads corresponding to a plurality of print colors, respectively, and the dummy image is formed with a plurality of colors printed by the plurality of printing heads.

30. A storage medium storing a program readable by an information processing apparatus, the program including:

a calibration process including a process for outputting test image data to cause a printing apparatus to print a test image used for a calibration at the printing apparatus, wherein the test image includes a measure image which is a subject of a measurement and a dummy image which is not a subject of the measurement, and the dummy image is printed at least at a part of a periphery of an area on which the measure image is printed, on a printing medium.

* * * * *

UNITED STATES PATENT AND TRADEMARK OFFICE

CERTIFICATE OF CORRECTION

PATENT NO. : 6,761,426 B2
DATED : July 13, 2004
INVENTOR(S) : Tsuchiya et al.

It is certified that error appears in the above-identified patent and that said Letters Patent is hereby corrected as shown below:

Column 7,
Line 67, “FIG. 8.” should read -- FIG. 8; --.

Column 8,
Line 46, “The Os 102” should read -- The OS 102 --.

Column 10,
Line 48, ““home position” should read -- “home position” --.
Line 49, “ HP”).” should read -- “HP”). --.

Column 11,
Line 5, “C, M, Y. K,” should read -- C, M, Y, K, --.

Column 12,
Line 29, “for.” should read -- for --.

Column 15,
Line 13, “though”should read -- through --.

Column 22,
Line 3, “are” should read -- and --.

Signed and Sealed this

Fifth Day of April, 2005

JON W. DUDAS
*Director of the United States Patent and Trademark Office*